US006786581B1

(12) United States Patent
Shinada et al.

(10) Patent No.: US 6,786,581 B1
(45) Date of Patent: Sep. 7, 2004

(54) INK-JET PRINTING APPARATUS AND INK CARTRIDGE

(75) Inventors: Satoshi Shinada, Nagano (JP); Takeo Seino, Nagano (JP); Hisashi Miyazawa, Nagano (JP); Koichi Toba, Nagano (JP); Takahiro Naka, Nagano (JP); Minoru Usui, Nagano (JP); Atsushi Kobayashi, Nagano (JP); Hitoshi Hayakawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/437,246

(22) Filed: Nov. 10, 1999

(30) Foreign Application Priority Data

| | | |
|---|---|---|
| Nov. 11, 1998 | (JP) | 10-320113 |
| Mar. 4, 1999 | (JP) | 11-056676 |
| Aug. 12, 1999 | (JP) | 11-228430 |

(51) Int. Cl.[7] ..... B41J 2/175
(52) U.S. Cl. ..... 347/86
(58) Field of Search ..... 347/84–87; 137/322, 137/878, 614.05; 251/149.6

(56) References Cited

U.S. PATENT DOCUMENTS

| | | | | |
|---|---|---|---|---|
| 4,162,501 A | * | 7/1979 | Mitchell et al. | 347/86 |
| 4,629,164 A | | 12/1986 | Sommerville | 239/69 |
| 4,680,696 A | | 7/1987 | Ebinuma | 346/75 |
| 5,603,577 A | | 2/1997 | Suzuki et al. | |
| 5,650,811 A | * | 7/1997 | Seccombe et al. | 347/85 |
| 5,732,751 A | | 3/1998 | Schmidt et al. | |
| 5,777,646 A | | 7/1998 | Barinaga et al. | |
| 5,790,158 A | * | 8/1998 | Shinada et al. | 347/86 |
| 6,036,305 A | * | 3/2000 | Nagasaki et al. | 347/86 |
| 6,302,531 B1 | * | 10/2001 | Usui et al. | 347/86 |
| 6,312,115 B1 | | 11/2001 | Hara et al. | |

FOREIGN PATENT DOCUMENTS

| | | | |
|---|---|---|---|
| EP | 0 498 117 A2 | 8/1992 | B41J/2/175 |
| EP | 0 562 717 A1 | 9/1993 | |
| EP | 0 792 748 A2 | 9/1997 | B41J/2/175 |
| EP | 0 864 428 A2 | 9/1998 | |
| GB | 2 323 332 A | 9/1998 | |
| JP | 5-229137 A | 9/1993 | |

OTHER PUBLICATIONS

European Search Report, Feb. 21, 2000, pp. 2–3.

* cited by examiner

*Primary Examiner*—Michael Nghiem
(74) *Attorney, Agent, or Firm*—Sughrue Mion, PLLC

(57) ABSTRACT

An ink cartridge for a printing apparatus providing ink to a print head through a tapered ink supply needle and removably attached to the print head. The ink cartridge includes an ink chamber for containing ink, an ink supply port, a packing member and a valve device. The ink supply port supplies ink from the ink chamber to the print head of the printing apparatus, the ink supply port including an external opening. The packing member is provided in the ink supply port and forms an ink channel for allowing a flow of ink. The packing member seals the ink supply needle of the printing apparatus by fitting therewith. The valve device is contained in the ink supply port and elastically abuts against the packing member. The valve device selectively opens and closes the ink channel in conjunction with the ink supply needle.

44 Claims, 28 Drawing Sheets

(A)

82
84
8
104

82
80
30
8
32
14
36

INK-JET PRINTING APPARATUS AND INK CARTRIDGE

This patent application claims priority based on Japanese patent applications, H10-320113 filed on Nov. 11, 1998, H11-228430 filed on Aug. 12, 1999 and H11-56676 filed on Mar. 4, 1999, the contents of which are incorporated herein by reference.

BACKGROUND OF THE INVENTION

1. Field of the Invention

The present invention relates to a printing apparatus for ejecting ink on a printing medium from a print head supplied with ink through a tapered ink supply needle, and more particularly to an ink cartridge and an ink supply system removably attached to the printing apparatus.

2. Description of the Related Art

Typically, an ink cartridge having a supply port for providing ink is connected to a print head of a printing apparatus for ejecting ink on a printing medium from nozzle aperture of the print head. The printing apparatus has a hollow ink supply needle in the ink supply channel to supply ink to the print head. When the ink cartridge is mounted on the printing apparatus, the hollow ink supply needle is inserted into the ink supply port of the ink cartridge so that ink is introduced to the print head.

When the ink cartridge includes a porous member within its ink chamber for absorbing ink, the ink chamber receives a negative pressure by the porous member. Therefore, the ink cartridge needs to be sealed so as not to suck air or bubbles in the ink chamber, which would be undesirable.

FIG. 27 is a cross sectional view of an example of an ink artridge and an ink supply channel. The ink cartridge 112 has an ink supply port 114 and a packing member 120 contained in the ink supply port 114 and fitting with an ink supply needle 118 which is connected to a print head 116. The ink supply port 114 is sealed with a sealing film, not shown in the drawings, prior to use. When the ink supply needle 118 is inserted in the ink supply port 114 and fitted in the packing member 120, the ink supply needle 118 penetrates the sealing film. Ink is then provided to the print head 116 via the ink supply needle 118. The ink cartridge 112 is sealed by fitting the ink supply needle 118 with the packing member 120.

When the ink cartridge 112 is removed from the printing apparatus with ink left therein, the sealing of the ink supply needle 118 with the packing member 120 is released. The result is that ink leaks from the ink supply port 114 or that air or a bubble enters the ink supply port 114. This means that a user of the ink cartridge cannot remove the ink cartridge until ink in the ink cartridge is completely used up. The user cannot repeatedly exchange a plurality of ink cartridges with his choice while ink still remains in the ink cartridge. There has been provided an ink cartridge as disclosed, for example, in U.S. Pat. No. 5,777,646, having an elastic slit wall formed at an opening of an ink supply port and a ball slidably received in the ink supply port which is always urged against the elastic slit wall by a spring.

An ink supply channel of the conventional ink cartridge described above is opened by urging the ball with a hollow ink supply needle of the printing apparatus when the ink cartridge is mounted on the apparatus. The ink supply channel of the ink cartridge is closed when the hollow ink supply needle is removed from elastic slit wall because of the elastic force of the spring which always urges the ball against the elastic slit wall of the ink supply port. Therefore, ink does not leak from the ink supply port and air or bubble does not enter the ink supply port.

The conventional ink cartridge, however, has a drawback that the structure of the ink supply port is complicated as shown in FIG. 27. Therefore, the workability of the ink cartridge is deteriorated, and the manufacturing cost would rise up.

FIG. 28 shows another example of a conventional ink cartridge disclosed in Japanese patent application No. 5-229137 employing a packing member, or a rubber member disposed in the ink supply port and a ball which is urged against the packing member by a spring. Ink is supplied from an ink chamber to a print head via a cylindrical connecting means. The ball is urged by the cylindrical connecting means to move away from the packing member against the elastic force of the spring.

The ink cartridge illustrated in FIG. 28 has a packing member 134 disposed in the ink supply port 132 and a ball 136 abutting against the packing member 134 by means of an elastic force of a spring 138.

In the conventional ink cartridge shown and FIG. 28, the packing member 134 serves as a valve seat sealing the ink supply port 132 with the connecting means, and the ball 136 serves as a valve body closing the ink supply port 132 in cooperation with the packing member 134. However, the relative position between the ball 136 and the spring 138 is unstable. This may cause an undesirable insufficient sealing by the ball 136 with the packing member 134. Furthermore, the connecting means needs to have a large contact area to sufficiently urge the ball 136 against the elastic force of the spring. Therefore, the connecting means is not easily inserted in the packing member 134. Furthermore, because the ball 136 is always urged toward the packing member 134 by the spring, the through hole of the packing member 134 may be expanded. This is disadvantageous because it may cause an insufficient connection between the ball 136 and the packing member 134.

SUMMARY OF THE INVENTION

The present invention was made in view of the foregoing problems or drawbacks accompanying the conventional sealing structure of the conventional ink cartridge. Therefore, it is an object of the present invention to provide an ink cartridge and an ink supply system for an ink jet type printing apparatus capable of closing an ink supply channel assuredly, sufficiently when it is not mounted on the printing apparatus and capable of opening the ink supply channel to allow ink to smoothly flow to a print head when it is mounted on the printing apparatus.

Another object of the present invention is to provide an ink-jet type printing apparatus employing such ink cartridge.

The above and other objects can be achieved by combinations of the features recited in independent claims of the present application. Dependent claims define further advantages and exemplary combinations of the present invention.

In order to solve the above-stated problems and drawbacks accompanying the conventional ink cartridges, the present invention provides an ink cartridge for a printing apparatus providing ink to a print head through a tapered ink supply needle and removably attached to the print head, including: an ink chamber for containing ink; an ink supply port for supplying ink from the ink chamber to the print head of the printing apparatus, the ink supply port including an external opening; a packing member provided in the ink supply port, forming an ink channel for allowing a flow of ink, the packing member sealing the ink supply needle of the printing apparatus by fitting therewith; and a valve device contained in the ink supply port elastically abutting against the packing member, the valve device selectively opening and closing the ink channel in conjunction with the ink supply needle.

In order to solve the above-stated problems and drawbacks accompanying the conventional ink cartridges, the present invention further provides an ink cartridge for a printing apparatus providing ink to a print head through an ink supply needle and removably attached to the print head, including: an ink chamber for containing ink; an ink supply port for supplying ink from the ink chamber to the print head of the printing apparatus, the ink supply port including an external opening; a packing member provided in the ink supply port, forming an ink channel for allowing a flow of ink, the packing member sealing the ink supply needle of the printing apparatus by fitting therewith; and a valve device contained in the ink supply port elastically abutting against the packing member, the valve device selectively opening and closing the ink channel in conjunction with the ink supply needle, the valve device being urged by the ink supply needle of the printing apparatus to open the ink channel at a same time when the ink supply needle is sealed by the packing member.

The valve device may come to close the ink channel of the packing member before the ink supply needle of the printing apparatus is completely detached from the packing member.

In order to solve the above-stated problems and drawbacks accompanying the conventional ink cartridges, the present invention further provides an ink cartridge for a printing apparatus providing ink to a print head through an ink supply needle and removably attached to the print head, including: an ink chamber for containing ink; a porous member accommodated in the ink chamber for absorbing ink; an ink supply port for supplying ink from the ink chamber to the print head of the printing apparatus, the ink supply port including an external opening; a packing member provided in the ink supply port, forming an ink channel for allowing a flow of ink, the packing member sealing the ink supply needle of the printing apparatus by fitting therewith; and a valve device contained in the ink supply port elastically abutting against the packing member, the valve device selectively opening and closing the ink channel in conjunction with the ink supply needle.

In order to solve the above-stated problems and drawbacks accompanying the conventional ink cartridges, the present invention further provides an ink cartridge for a printing apparatus providing ink to a print head through an ink supply needle and removably attached to the print head, including: an ink chamber for containing ink; an ink supply port for supplying ink from the ink chamber to the print head of the printing apparatus, the ink supply port including an external opening; a packing member provided in the ink supply port, forming an ink channel for allowing a flow of ink, the packing member sealing the ink supply needle of the printing apparatus by fitting therewith, the packing member including a hole and a protruding rim surrounding the hole; and a valve device contained in the ink supply port elastically abutting against the packing member, the valve device selectively opening and closing the ink channel in conjunction with the ink supply needle, the valve device including a substantially flat surface at least at a part with which the ink supply needle contacts.

The packing member may include a first surface facing the ink chamber formed with a cylindrical recess having a diameter acceptable to receive a part of the valve device at the first surface.

The hole of the packing member may have a diameter smaller than the diameter of the cylindrical recess at the first surface.

In order to solve the above-stated problems and drawbacks accompanying the conventional ink cartridges, the present invention further provides an ink cartridge for a printing apparatus providing ink to a print head through an ink supply needle and removably attached to the print head, including: an ink chamber for containing ink; an ink supply port for supplying ink from the ink chamber to the print head of the printing apparatus, the ink supply port including an external opening; a packing member provided in the ink supply port, forming an ink channel for allowing a flow of ink, the packing member sealing the ink supply needle of the printing apparatus by fitting therewith; and a valve device contained in the ink supply port elastically abutting against the packing member, the valve device selectively opening and closing the ink channel in conjunction with the ink supply needle, the valve device including a valve body contacting with the packing member and including a substantially flat surface with which the ink supply needle contacts.

In order to solve the above-stated problems and drawbacks accompanying the conventional ink cartridges, the present invention further provides an ink cartridge for a printing apparatus providing ink to a print head through an ink supply needle and removably attached to the print head, including: an ink chamber for containing ink; an ink supply port for supplying ink from the ink chamber to the print head of the printing apparatus, the ink supply port including an external opening; a packing member provided in the ink supply port, forming an ink channel for allowing a flow of ink, the packing member sealing the ink supply needle of the printing apparatus by fitting therewith; and a valve device contained in the ink supply port elastically abutting against the packing member, the valve device selectively opening and closing the ink channel in conjunction with the ink supply needle, the valve device including: a valve body contacting with the packing member and urged by the ink supply needle of the printing apparatus to open the ink channel when the ink cartridge is mounted on the printing apparatus; and a guide body for guiding the valve body to slide substantially vertically with respect to the packing member.

The valve device may include: a valve member selectively contacting with a surface of the packing member, the valve member being forced by the ink supply needle of the printing apparatus when the ink cartridge is mounted on the printing apparatus; and an elastic member always urging the valve member toward the packing member.

The valve member may include a support structure for supporting the elastic member. The support structure may be radially shaped. The valve member may include a flange for supporting the elastic member.

The packing member may also include a second surface facing the external opening with a tapered portion tapered from the external opening toward the ink chamber at the second surface, for guiding the ink supply needle of the printing apparatus. The tapered portion may fit with the ink supply needle.

The packing member may include a second surface facing the external opening with a fitting portion to fit with the ink supply needle of the printing apparatus.

The packing member may be made of an elastic material and provided with a lubricant coat at least at an area with which the ink supply needle contacts.

The valve device may include a substantially flat surface with which the ink supply needle contacts.

The valve body may include: a sealing portion for closing the ink channel of the packing member when the valve body contacts with the packing member; and an ink channel allowing ink to pass therethrough when the valve body is urged to come out of contact with the packing member by the ink supply needle of the printing apparatus.

At least a part of the ink channel of the valve body may be formed by cutting off the sealing portion.

The sealing portion of the valve body may include a substantially flat surface with which the ink supply needle contacts.

The guide body may include: an axial portion being connected to the valve body; and a guide block formed at an end of the axial portion opposite to the valve body, the guide block guiding the valve body to slide substantially vertically with respect to the packing member.

The axial portion of the guide body may be formed as one unit with the valve body.

The ink cartridge may further include a guide unit provided in the ink supply port to receive the guide block of the guide body.

The valve body and the guide body may be separately formed and fixed to each other by fixing means.

The guide body may be made of an elastic material. The guide body may be formed with a groove extending from the guide block through the axial portion.

The valve body of the valve device may include a surface facing the packing member formed with a convex surface.

The valve body of the valve device may include a surface, facing the packing member, formed with a protruding portion to contact with a tip end of the ink supply needle.

The valve body of the valve device may include a surface, facing the packing member, provided with a notch.

The notch of the valve body may have a tapered angle which is the same as that of the tapered ink supply needle.

The channel of the valve body may have a tapered angle which is smaller than that of the tapered ink supply needle.

The valve body of the valve device may include a surface, facing the packing member, formed with a spherical surface contacting with a tip end of the ink supply needle.

The spherical surface of the valve device may have a diameter of curvature larger than a diameter of a widest part of the valve body.

The packing member may include a first surface facing the ink chamber with a protruding portion having a hole whose diameter is smaller than the diameter of the ink supply needle of the printing apparatus.

The packing member may include a first surface facing the ink chamber with a protruding portion having a hole whose diameter is smaller than the diameter of the ink supply needle of the printing apparatus.

The spherical surface of the valve device may be formed with a flat portion at its center having a smaller diameter than a diameter of the hole of the protruding portion of the packing member.

The valve device may include: a valve body contacting with the packing member and urged by the ink supply needle of the printing apparatus to open the ink channel when the ink cartridge is mounted on the printing apparatus; and an elastic support portion for supporting the valve body.

The ink cartridge may further include a packing retainer for retaining the packing member at the external opening of the ink supply port.

The packing retainer may include a film capable of being penetrated by the ink supply needle of the printing apparatus.

The film may be formed with a hole which enables the ink supply needle to easily pass through.

The hole may be formed by cutting the film in a cross shape.

The packing retainer may be a protruding portion protruding from the external opening toward the center thereof.

The ink supply port may have an internal opening open to the ink chamber, and the ink cartridge further includes a filter provided at the internal opening.

The fitting portion may include a first fitting position for fitting the ink supply needle of the printing apparatus when the ink supply needle is inserted from the external opening, and a second fitting position for fitting the ink supply needle when the ink supply needle is further inserted toward the ink chamber.

The first fitting position may be initially sealed prior to use.

According to another aspect of the present invention, in the above-stated problems and drawbacks can be solved by a provision of an ink supply system for an ink-jet type printing apparatus supplying ink contained in an ink cartridge to a print head through a tapered ink supply needle, the ink supplying system including: an ink channel for providing ink from the ink chamber to the print head of the printing apparatus; a first member provided at the ink channel, forming a part of the ink channel for allowing a flow of ink, the first member sealing the ink supply needle of the ink printing apparatus by fitting therewith; and a second member contained in the ink channel elastically abutting against the first member, the second member selectively opening and closing the ink channel in conjunction with the ink supply needle.

According to still another aspect of the present invention, the above-stated problems and drawbacks can be solved by a provision of a printing apparatus for ejecting ink on a printing medium, which includes: a print head; a tapered ink supply needle; and an ink cartridge communicating with the print head through the tapered ink supply needle and removably attached to the print head. The ink cartridge includes: an ink chamber for containing ink; an ink supply port for supplying ink from the ink chamber to the print head of the printing apparatus, the ink supply port comprising an external opening; a packing member provided in the ink supply port, forming an ink channel for allowing a flow of ink, the packing member sealing the ink supply needle of the printing apparatus by fitting therewith; and a valve device contained in the ink supply port elastically abutting against the packing member, the valve device selectively opening and closing the ink channel in conjunction with the ink supply needle.

DETAILED DESCRIPTION OF THE INVENTION

Preferred embodiments of the present invention will now be described in detail with reference to the accompanying drawings. The embodiments described as follows are not intended to limit the scope of the present invention, but merely exemplify the invention. Not all of the features and the combinations thereof described in the embodiment are necessarily essential to the invention.

Figure 1:
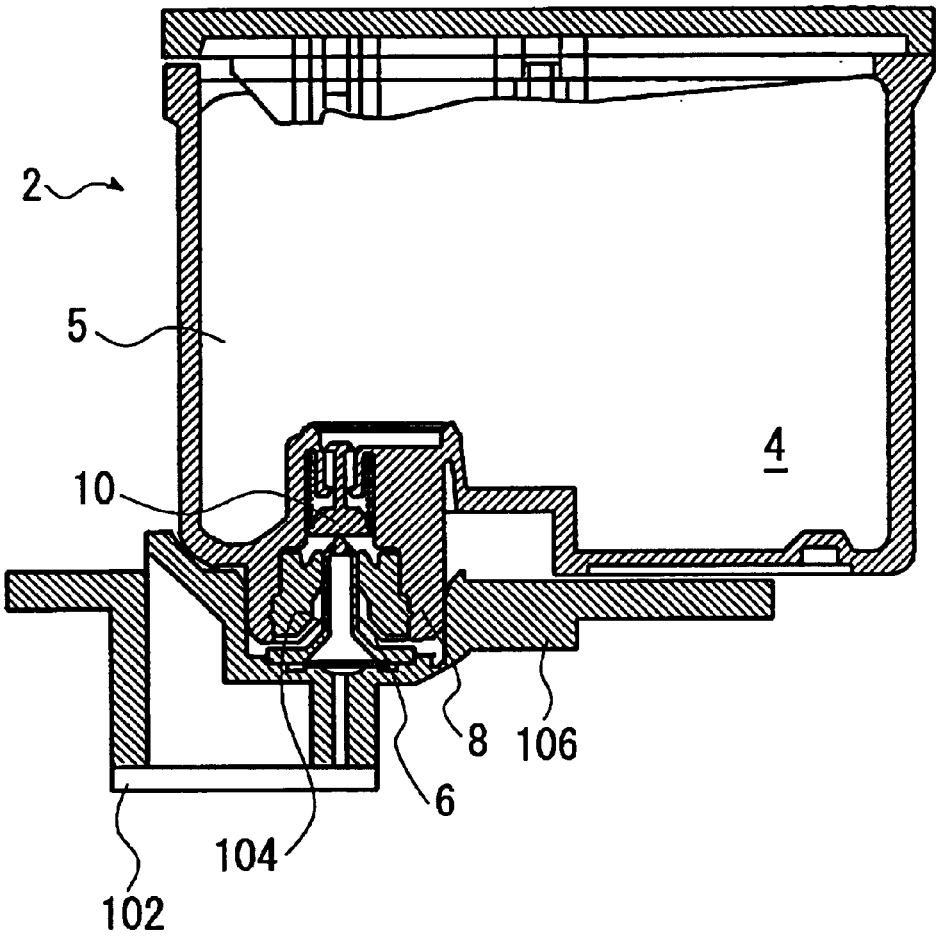
FIG. 1 shows a cross sectional view of the ink cartridge according to the present invention with a part of the printing apparatus comprising the print head.

FIG. 1 shows a first embodiment of an ink cartridge according to the present invention. As shown and FIG. 1, an ink cartridge 2 has an ink chamber 4 for containing ink, and an ink supply port 6 designed to establish an ink communication with the ink chamber 4. The ink cartridge 2 is also provided with a packing member 8 disposed within the ink supply port 6, and a valve member 10 located between the ink chamber 4 and the packing member 8. The valve member 10 is always urged toward the packing member 8 by an elastic force of a compression spring 12 (see FIG. 2). The packing member 8 is made of an elastic material such as a rubber or a plastic. The ink chamber 4 accommodates therein a porous member 5 which absorbs ink. Because of the fact that ink is absorbed in the porous member 5, ink is retained in the ink chamber in a stable manner without splashing, even with the ink cartridge being mounted on a carriage of a printing apparatus reciprocating at a high speed. As the porous member 5 is accommodated in the ink chamber 4, the ink chamber 4 is always at a negative pressure.

FIG. 1 shows a part of the printing apparatus. The printing apparatus has a print head 102 fixed on the carriage, not shown in the drawings, a tapered ink supply needle 104 designed to establish a fluid communication with the print head 102, and an ink cartridge holder 106. The ink cartridge 2 is mounted on the ink cartridge holder 106 of the printing apparatus in such a way that the ink supply port 6 faces the ink supply needle 104 of the printing apparatus. When the ink cartridge 2 is mounted on the printing apparatus, the packing member 8 in the ink supply port 6 fits with the ink supply needle 104. The ink is then introduced from the ink chamber 4 to the print head 102 through holes formed in the tip end of the ink supply needle 104.

Figure 2:
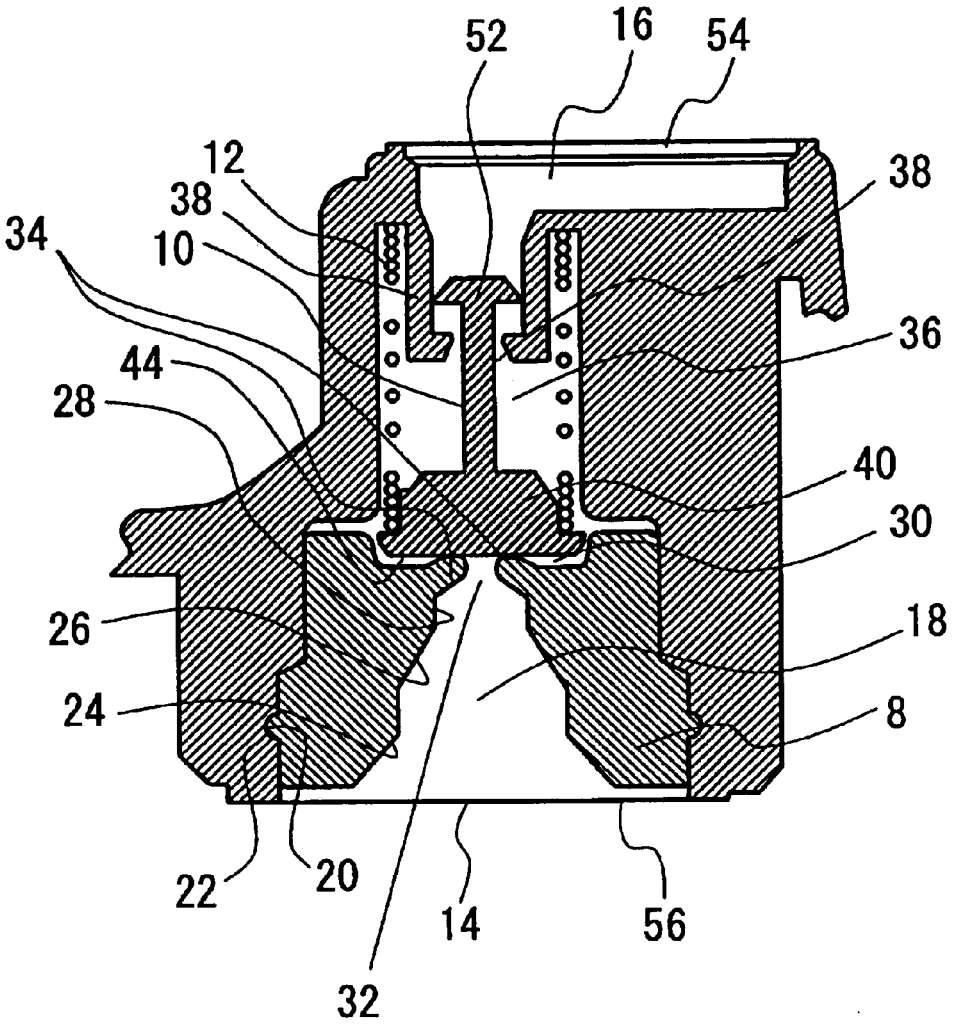
FIG. 2 is an enlarged cross sectional view of the ink supply port of the ink cartridge shown in FIG. 1.

FIG. 2 is an enlarged cross sectional view showing the ink cartridge 2. The ink supply port 6 is provided with an external opening 14 coupling to the ink supply needle 104 of the printing apparatus, and an internal opening 16 opening to the ink chamber 4.

The packing member 8 is press-fitted in the ink supply port 6. The packing member 8 has a protruding portion 20 on its outside surface, fitting with a concave 22 formed on the side wall of the ink supply port 6, in order to have the packing member 8 retained in the ink supply port 6. The protruding portion 20 of the packing member 8 seals with the concave 22 of the ink supply port 6. Thus, ink does not leak from the ink supply port 6.

The packing member 8 is made of an elastic material such as a rubber material including a silicon rubber, a chloroprene rubber, a butyl rubber, a ethylene-propylene rubber, a nitrile rubber, and an elastmer material. The packing member 8 is provided, if desired, with a lubricant coat at areas with which the ink supply needle 104 contacts, in order to smoothly receive the ink supply needle 104. The lubricant coat consists of a silicon resin or a fluorocarbon resin.

One surface of the packing member 8 faces the ink chamber 4. This surface of the packing member is formed with a cylindrical recess 30 having a diameter compatible to receipt of a part of the valve device, which will be explained in detail hereinbelow. The packing member 8 has a hole 32 defined in the center thereof, capable of receiving the ink supply needle 104 formed in the cylindrical recess 30, having a diameter smaller than the diameter of the cylindrical recess 30, thereby to form an ink channel.

The hole 32 of the packing member 8 expands and seals the ink supply needle 104 of the printing apparatus, when the ink supply needle 104 is inserted into the hole 32. The packing member 8 is formed with a protruding rim 34 surrounding the hole 32 formed in the above-mentioned surface of the packing member 8.

The packing member 8 has a second surface facing the external opening 14, with a first tapered portion 24 and a second tapered portion 26. Each tapered portion on the second surface is tapered from the external opening 14 toward the ink chamber 4 for the purpose of guiding the ink supply needle 104 of the printing apparatus. The packing member 8 is also provided with a fitting portion 28 formed on the second surface, to fit with the ink supply needle 104 of the printing apparatus.

The packing member 8 is press-fitted in the ink supply port 6 and defines an ink introducing chamber 36 within the ink supply port 6. The ink introducing chamber 36 is an area defined between the packing member 8 and the ink chamber 4. The valve member 10 is received in the ink introducing chamber 36. The ink introducing chamber 36 has a cylindrical guide unit 38 having a through bore 38*a*. The guide unit 38 receives a part of the valve member 10 in order to guide the valve member 10. The guide unit 38 contacts with the part of the valve member 10 necessary to have the valve member 10 moved vertically with respect to the packing member 8. The valve member 10 is always urged by a compression spring 12 toward the packing member 8, to contact with the packing member for selectively closing the ink channel of the packing member 8.

Figure 3:
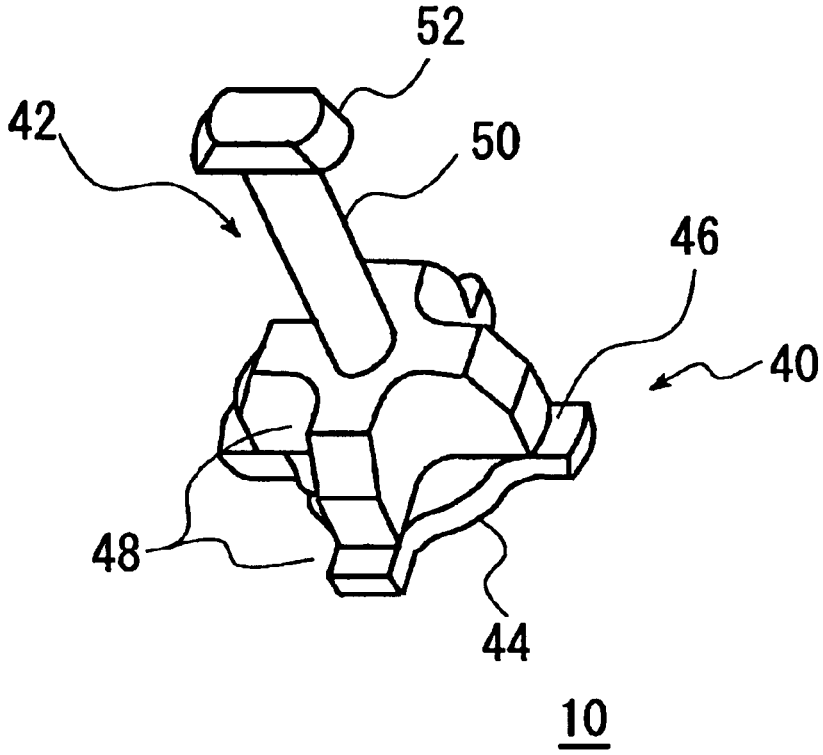
FIG. 3 shows the valve member of the ink cartridge shown in FIG. 2.

FIG. 3 shows an embodiment of the valve member 10. The valve member 10 has a valve body 40 contacting with the packing member 8, and a guide body 42 for guiding the valve body 40. The guide body 42 helps the valve body 40 to move vertically with respect to the packing member, when the valve member 10 is received in the ink introducing chamber 36. The valve body 40 has a sealing portion 44 for sealing the ink channel of the packing member 8 when the valve body 40 contacts with the packing member 8, a spring support structure 46 for supporting the compression spring 12, and an ink channel 48 suitable for the passage of ink when the valve body comes out of contact with the packing member by the ink supply needle of the printing apparatus. Here, the sealing portion 44 is substantially flat. A part of the ink channel 48 is formed by cutting off the sealing portion 44. The guide body 42 has an axial portion 50 connecting to the valve body 40, and a guide block 52 formed at an end of the axial portion 50 opposite to the valve body 40.

Referring back to FIG. 2, the guide block 52 is slidably received in the guide unit 38. The guide block 52 has a diameter larger than a diameter of the through bore 38*a* of the guide unit 38. The guide block 52 of the valve member 10 cooperates with the guide unit 38, to have the valve body 40 move vertically with respect to the packing member 8.

The print head 102 is of an ink jet type print head normally referred to as a piezoelectric type print head. In the piezoelectric type print head, by driving a piezoelectric transducer a pressure chamber is expanded to lead ink in, and applies a pressure to ink to eject ink droplets out of the print head. It is necessary to dissolve, during manufacturing, any bubbles in the ink within the cartridge of this type of print head, because bubbles in the ink may cause inadequate compression of the pressure chamber so that ink droplets do not eject as they are designed.

In this case, the ink is injected in the ink- cartridge at a negative pressure of minus 1 atom of the atmospheric pressure (1.033 kg/per square meter) when the ink cartridge is manufactured. The compression coil spring is designed to be strong enough to urge the valve member 10 toward the packing member 8 in order to have the valve member 10 form a contact with the packing member 8, even under the low pressure condition.

The internal opening 16 formed at the side of the ink supply port 6 opening to the ink chamber 4 has a dimension larger than the dimension of the ink introducing chamber 36 in which the valve member 10 is accommodated. The result is, ink can be smoothly introduced to the ink introducing chamber 36, and can likewise smoothly flow to the ink supply port 6. A filter 54 is provided between the internal opening 16 of the ink supply port 6 and the ink chamber 4 of the ink cartridge. The filter 54 collects dust or foreign particles existing in the ink chamber 4. Furthermore, as the filter 54 has a dimension the same as that of the internal opening 16, ink passes smoothly through the filter 54.

A sealing film 56 which is designed to be penetrated by the ink supply needle may be adhered to cover the external opening 14 for sealing the ink supply port 6 prior to use. The sealing film 56 serves to close the ink supply port 6 and also to retain the packing member 8 at the external opening 14 of the ink supply port 6.

The operation of the packing member 8 and the valve member 10, when the ink cartridge 2 is mounted on the printing apparatus will be explained in the following in the present embodiment.

As shown in FIG. 2, when the ink cartridge is not mounted on the printing apparatus, the valve body 40 is urged toward the packing member 8 by the compression spring 12. The sealing portion 44 contacts with the protruding rim 34 surrounding the hole 32 of the packing member 8. Thus, the ink introducing chamber 36 is closed by the packing member 8 and the valve member 10.

Figure 4:
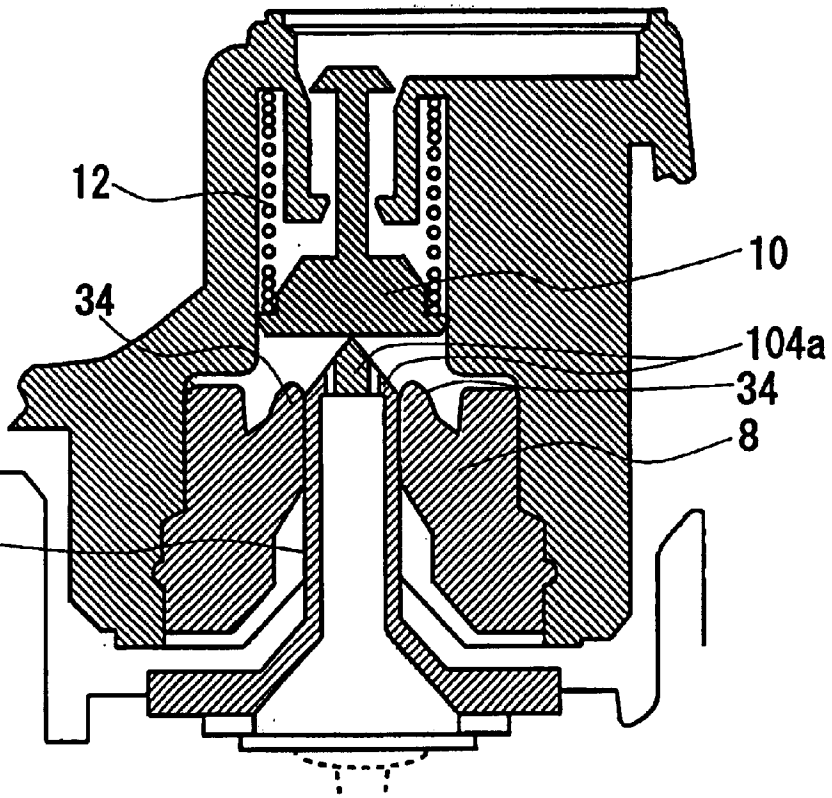
FIG. 4(A) shows the ink supply port of the ink cartridge with the ink supply needle of the printing apparatus.
FIG. 4(B) shows the ink supply port of the ink cartridge with the ink supply needle of the printing apparatus inserted therein.
Figure 4:
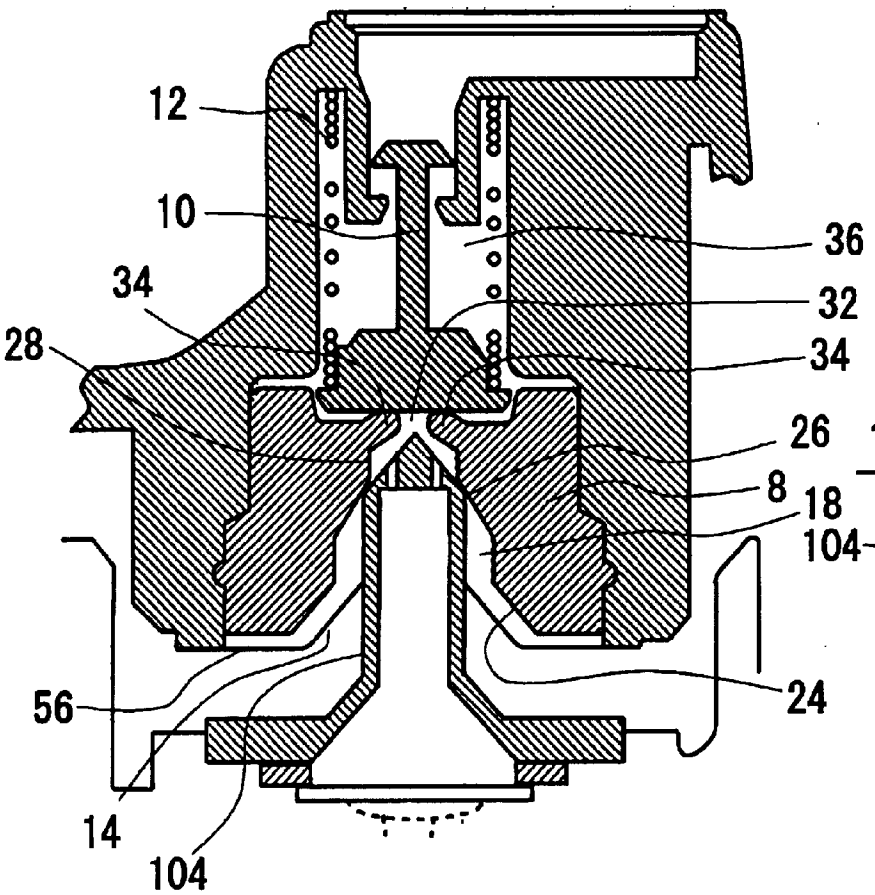

As shown in FIG. 4(A), the external opening 14 of the ink supply port 6 is adjusted to fit the ink supply needle 104 to have the ink cartridge 2 depressed in the ink cartridge holder 106 of the printing apparatus. The tapered ink supply needle 104 then penetrates the sealing film 56, to be inserted into the fitting portion 28 while being guided by the first and second tapered portions 24 and 26 of the packing member 8. When the ink cartridge 2 is further pushed into the cartridge holder 106 of the printing apparatus, the tapered ink supply needle 104 is smoothly inserted into the hole 32 of the packing member 8. This causes the hole 32 to expand, and the fitting portion 28 of the packing member 8 seals the ink supply needle 104 (see FIG. 4(B)). The ink supply needle 104 urges the flat sealing portion 44 of the valve member 10 upward. At the same time, the valve member 10 moves toward the ink chamber 4 against the elastic force of the compression spring 12.

The ink supply needle 104 becomes held in communication with the ink introducing chamber 36 via the hole formed in the tip end of the ink supply needle 104, and thus allows ink to flow to the print head 102.

When the cartridge 2 is removed from the printing apparatus, the ink supply needle 104 is detached from the packing member 8. The result is, the valve member 10 is urged toward the packing member 8 by the elastic force of the compression spring 12. The sealing portion 44 of the valve member 10 closes the ink channel of the packing member 8 when the ink supply needle 104 is completely detached from the packing member 8. It means that when the ink supply needle 104 is released from the fitting portion 28 of the packing member 8, at the same time, the sealing portion 44 of the valve body 40 is urged toward the packing member 8 to close the ink introducing chamber 36.

Figure 5:
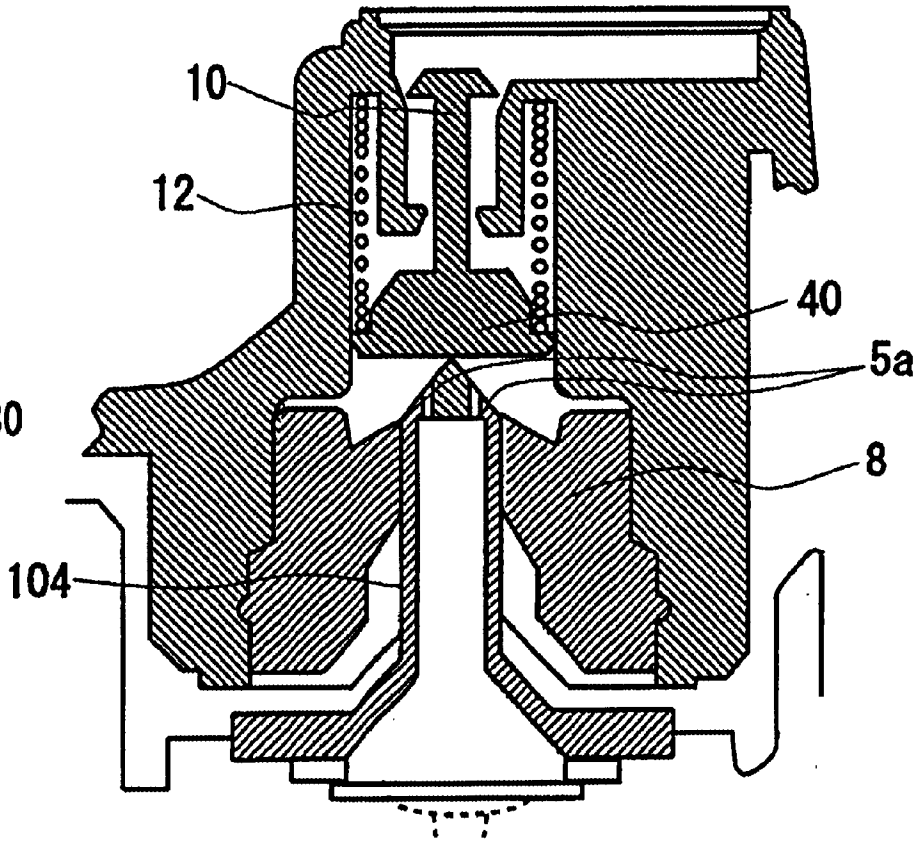
FIG. 5(A) shows another embodiment of the ink supply port f the ink cartridge.
FIG. 5(B) shows the ink supply port of the ink cartridge shown in FIG. 5(A) with the ink supply needle of the printing apparatus inserted therein.
Figure 5:
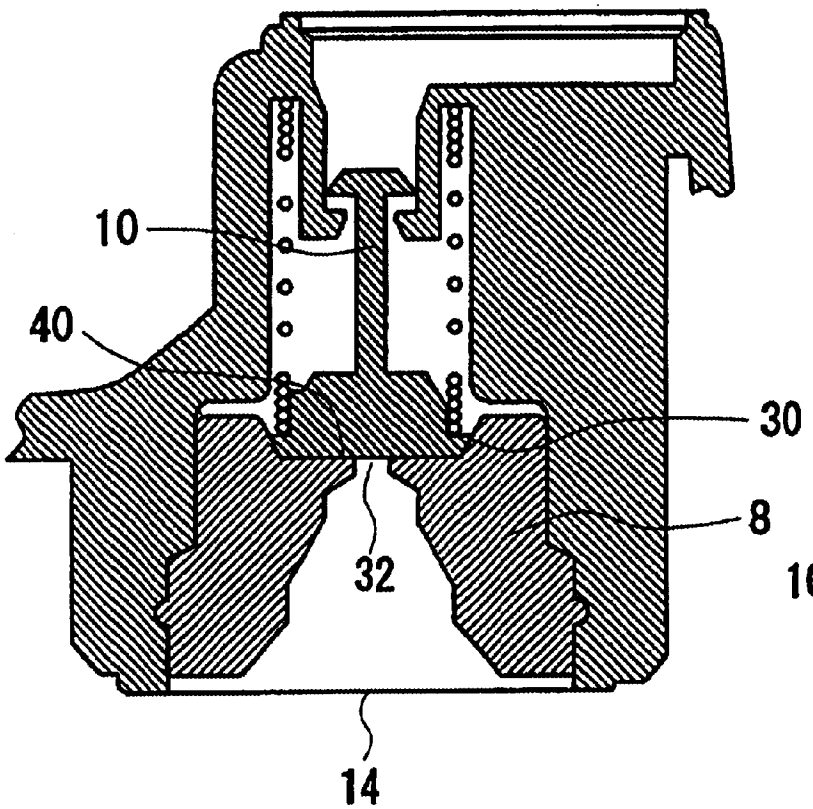

As shown in FIGS. 5(A) and 5(B), the packing member 8 may not be formed with a protruding rim 34 surrounding the hole 32 of the packing member 8, to have the valve body 40 contact with the surface of the cylindrical recess 30. FIG. 5(B) shows the packing member 8 and the ink supply needle 104 of the printing apparatus, when the external opening 14 of the ink cartridge 2 is designed to have a size allowing the ink supply needle 104 of the ink cartridge 2 to be pushed into the ink cartridge holder 106. In this case, the same operation as explained with reference to FIGS. 4(A) and 4(B) can be obtained.

Furthermore, even when dust or foreign particles is contained in ink, the sealed connection between the packing member 8 and the valve member 10 can be ensured, because the contacting surface between the valve body 40 and the cylindrical recess 30 of the packing member 8 is large.

Figure 6:
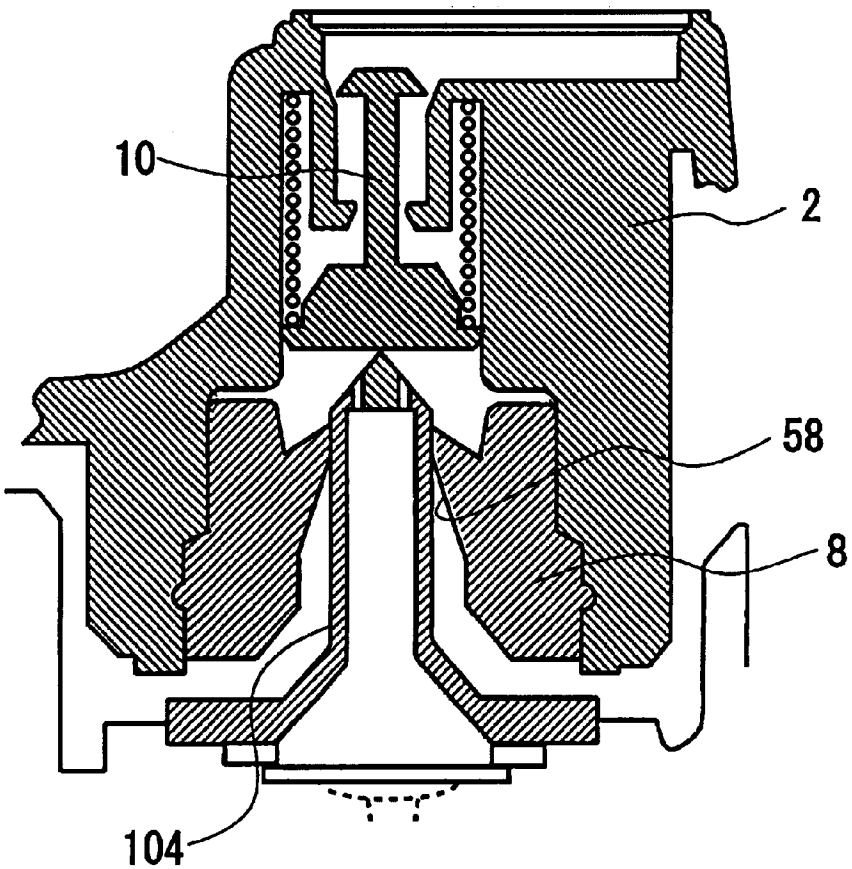
FIG. 6(A) shows another embodiment of the ink supply port of the ink cartridge.
FIG. 6(B) shows the ink supply port of the ink cartridge shown in FIG. 6(A) with the ink supply needle of the printing apparatus inserted therein.
Figure 6:
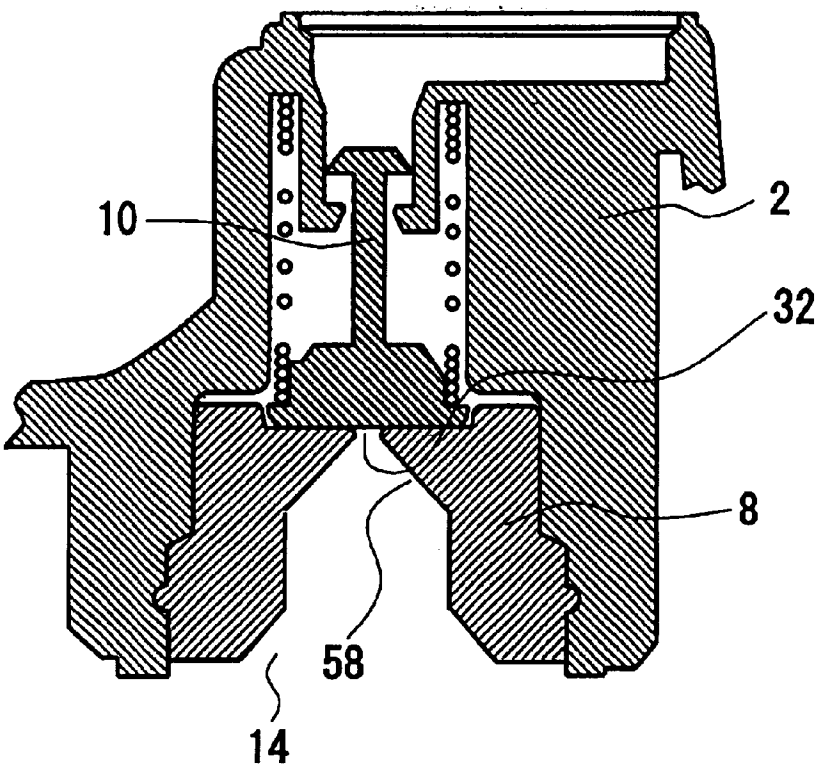
Figure 7:
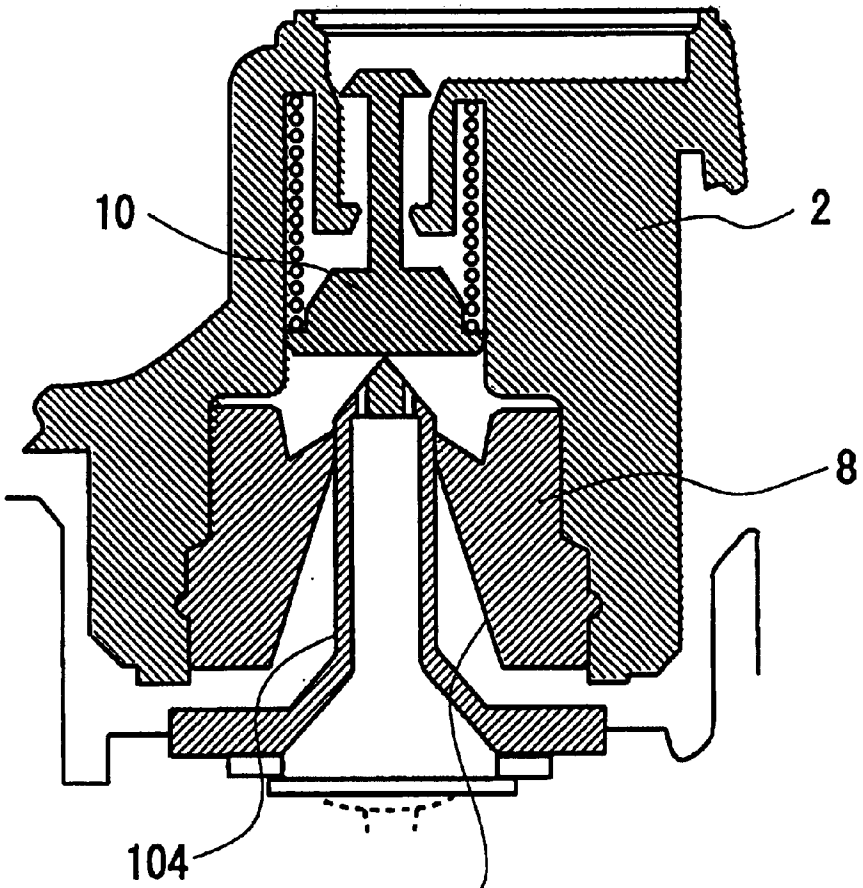
FIG. 7(A) shows another embodiment of the ink supply port of the ink cartridge.
FIG. 7(B) shows the ink supply port of the ink cartridge shown in FIG. 7(A) with the ink supply needle of the printing apparatus inserted therein.
Figure 7:
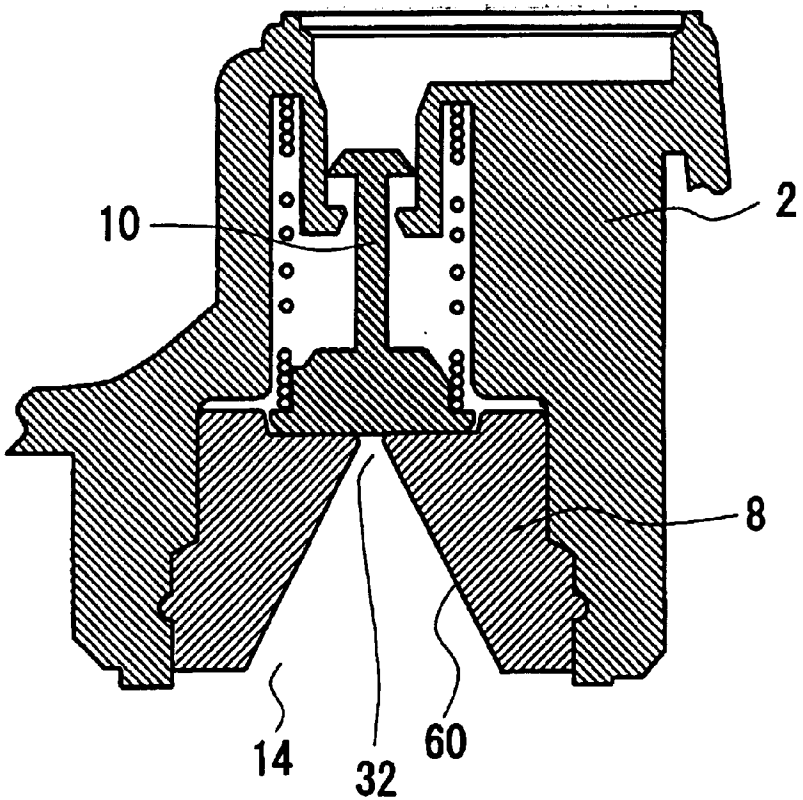

As shown in FIGS. 6(A) and 6(B), the packing member 8 may have a tapered portion 58 larger than the tapered ink supply needle 104 at the second surface. Furthermore, as shown in FIGS. 7(A) and 7(B), the packing member 8 may have a single tapered portion 60 tapered from the external opening 14 to the hole 32 of the packing member 8. In these cases, when the ink cartridge 2 is pushed into the ink cartridge holder 106 to have the ink supply needle 104 inserted into the hole 32 of the packing member 8, the tapered portion 58 and the tapered portion 60 each fit with the ink supply needle 104. The same operation as explained with reference to FIGS. 4(A) and 4(B) can also be obtained in these cases.

Furthermore, even when dust is contained in ink, the sealed connection between the packing member 8 and the valve member 10 can be ensured, because the contacting surface between the valve body 40 and the cylindrical recess 30 of the packing member 8 is large.

Further, in the embodiment shown in FIGS. 7(A) and 7(B), the sealed connection between the packing member 8 and the valve member 10 can be ensured because the fitting force between the tapered portion 60 and the ink supply needle 104 is strong.

Although the packing member 8 shown in this embodiment is formed as one unit, the packing member 8 may be separately formed as comprising two units; one of which is a part with which the valve member 10 contacts and the other of which is a part with which the ink supply needle 104 fits.

Figure 8:
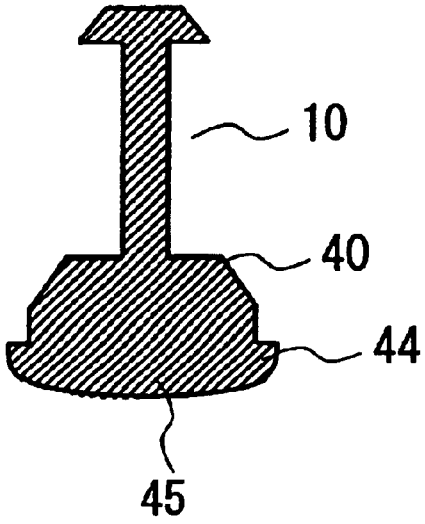
FIG. 8 shows a cross sectional view of another embodiment of the valve member.

FIG. 8 shows another example of the valve member 10 having a surface at the sealing portion 44, facing the packing member 8, formed with a spherical surface 45 to contact with the tip end of the ink supply needle 104. With this spherical surface 45 of the valve member 10, the sealed connection between the packing member 8 and the valve member 10 is ensured, even when the position of the valve member 10 varies.

Figure 9A:
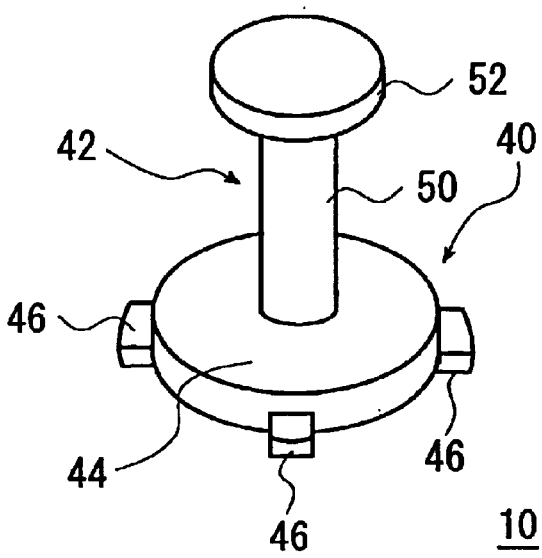
FIG. 9(A) shows another embodiment of the valve member.

FIG. 9(A) shows another embodiment of the valve member 10. The components of the valve member 10 shown in FIG. 9(A) are formed separately from one another, including a valve body 40 to form a contact with the packing member 8, and a guide body 42 for guiding the valve body 40 vertically with respect to the packing member 8. The valve body 40 has a sealing portion 44 and a plurality of, at least three, spring support structure 46 around the sealing portion 44. The guide body 42 is formed as one piece, with an axial portion 50 being connected to the valve body 40 and a guide block 52. The guide block 52 guides the valve body 40 vertically with respect to the packing member 8, in cooperation with the guide unit 38 of the ink introducing chamber 36. The end of the axial portion 50 of the guide body 42, opposite to the guide block 52, is secured to the sealing portion 44 of the valve body 40, to assemble the valve member 10.

The valve member 10 is incorporated in the ink supply port 6 by inserting the guide body 42 from the internal opening 16, to be passed through the guide unit 38 of the ink introducing chamber 36, entering the compression spring 12 from the internal opening 16 to be placed around the ink introducing chamber 36, and fixing the valve body 40 to the guide body 42.

Figure 9B:
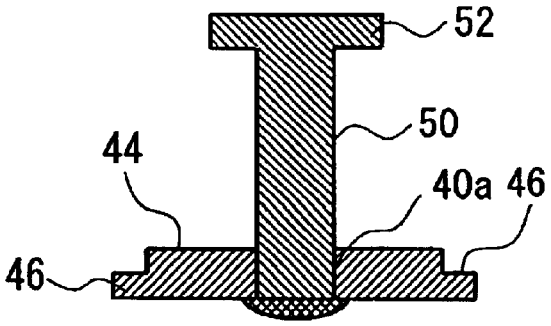
FIG. 9(B) shows a cross sectional view of another embodiment of the valve member.
Figure 9C:
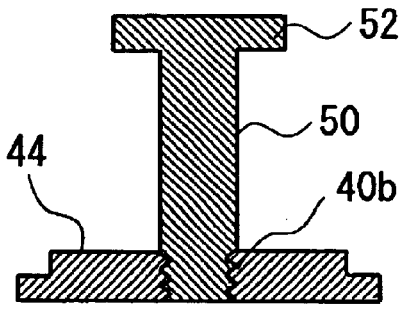
FIG. 9(C) shows a cross sectional view of another embodiment of the valve member.

The valve body 40 and the guide body 42 may be fixed to each other by providing a fixing hole 40*a* to the valve body 40. The guide body 42 is inserted into the fixing hole 40*a* of the valve body 40, and fixed by heat welding or adhesive as shown in FIG. 9(B). Otherwise, the valve body 40 and the guide body 42 may be fixed to each other by forming a fixing hole having a thread to the valve body 40, forming a thread to the axial portion 50, and connecting these parts to each other as shown in FIG. 9(C).

Figure 10:
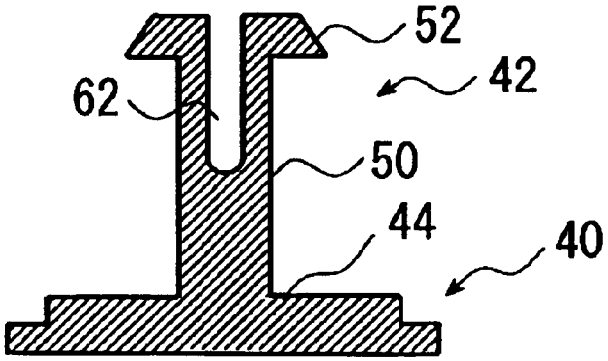
FIG. 10 shows a cross sectional view of another embodiment of the valve member.

FIG. 10 shows another embodiment of the valve member 10. The valve member 10 has a valve body 40 and a guide body 42. The guide body 42 is provided with an axial portion 50 and a guide block 52. The axial portion 50 and the guide block 52 of the guide body 42 are formed as one unit. The guide body 42 is made of an elastic material such as a plastic and formed with a groove 62 extending from the guide block 52 through the axial portion 50. The valve body 40 may be made of the same elastic material, such as a plastic, and formed as one unit with the guide body 42. When the ink cartridge 2 is mounted on the printing apparatus, the ink supply needle 104 contacts with and urges the valve body 40. The valve body 40 may therefore be made of a soft and flexible material which does not damage the tip end of the ink supply needle 104. The guide block 52 of the guide body 42 may be tapered toward the valve body 40 as shown in FIG. 10.

In this embodiment, the valve member 10 is incorporated in the ink supply port 6 by entering the compression spring 12 from the internal opening 16 to be placed around the ink introducing chamber 36. The edge of the guide body 42 having the groove 62 is pushed into the through bore 38*a* of the guide unit 38. The guide block 52 has a groove 62 which allows the guide block 52 to be buckled as it passes through the through bore 38*a*, and then spreads to be retained in the guide unit 38. In this case, the valve member 10 can be formed as one unit, therefore, the number of parts and working process are reduced.

In the embodiment as described above, the guide block 52 of the valve member 10 has a groove 62. However, the guide unit 38 may be formed to allow splitting into a plurality of strips for elastically accepting the guide block 52 of the valve device.

Figure 11:
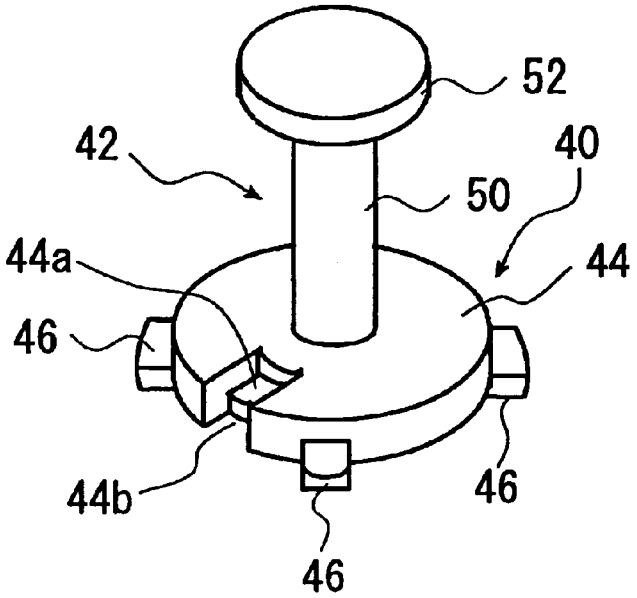
FIG. 11 shows a cross sectional view of another embodiment of the valve member.

As the valve member 10 is contained in the ink-introducing chamber 36, the valve member 10 needs to be manufactured in a small size. This leads that ink is not provided smoothly to the print head even when the ink channel is open. Therefore, as shown in FIG. 11, the valve member 10 is formed with a depression 44*a* and the penetrating portion 44*b* formed at the sealing portion 44 of the valve body 40 to allow ink to smoothly pass there through. The penetrating portion 44*b* is formed at the outside of the sealing portion so that the sealing portion 44 can close the hole 32 of the packing member 8 when the sealing portion 44 contacts with the packing member 8. The valve member 10 preferably has a plurality of these depressions 44*a* and penetrating portions 44*b* in order to pass ink from the ink chamber 4 to the print head smoothly.

Figure 12:
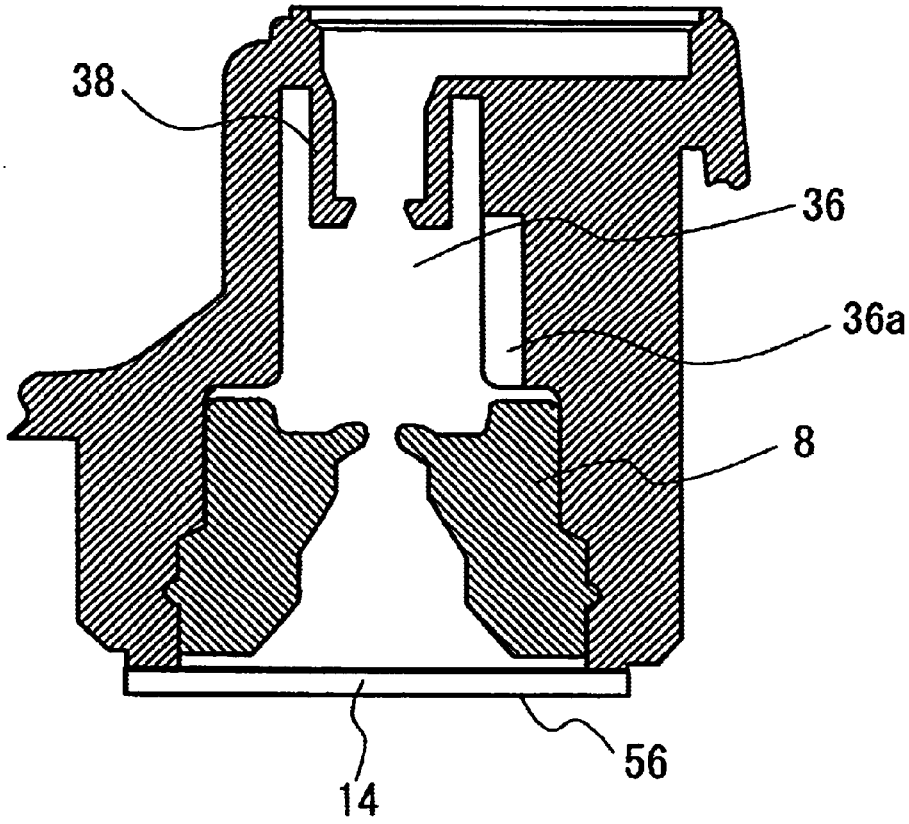
FIG. 12 shows an embodiment of the ink introducing chamber.

The ink introducing chamber 36 may have a depression 36*a* formed at the side wall of the ink introducing chamber 36. The depression 36*a* is formed from the upper point where the sealing portion 44 of the valve body 40 positions when the valve member 10 is not urged by the ink supply needle 104 to the point where the sealing portion 44 of the valve body 40 positions when the valve member 10 is urged by the ink supply needle 104 in FIG. 12. In this embodiment, ink is provided smoothly to the print head through the depression 36*a*. The valve member 10 having a depression 44*a* as shown in FIG. 11 may be used with this ink introducing chamber 36 as shown in FIG. 12.

Figure 13:
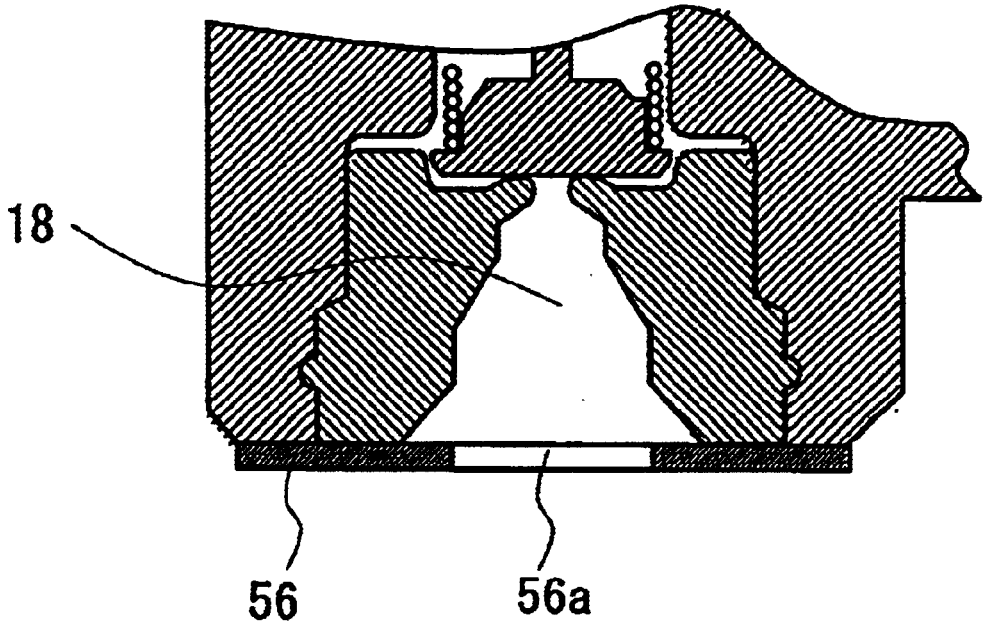
FIG. 13(A) is a cross sectional view of an embodiment of the packing retainer for the packing member.
FIG. 13(B) shows the packing retainer for the packing member shown in FIG. 13(A)
Figure 13:
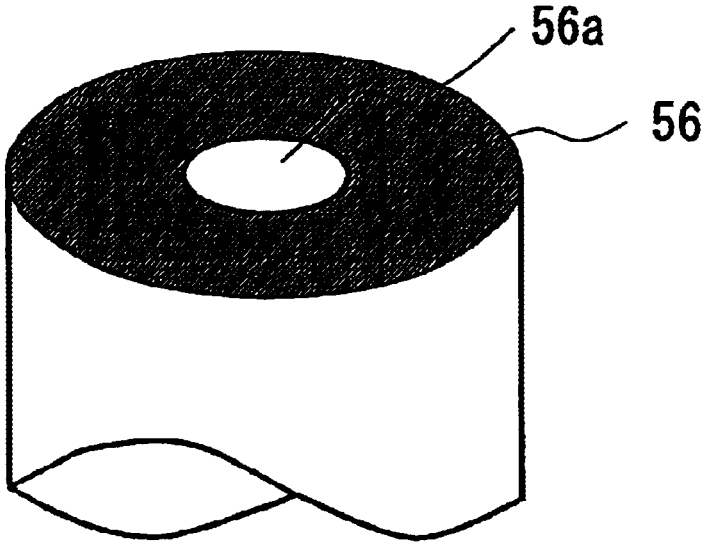
Figure 14:
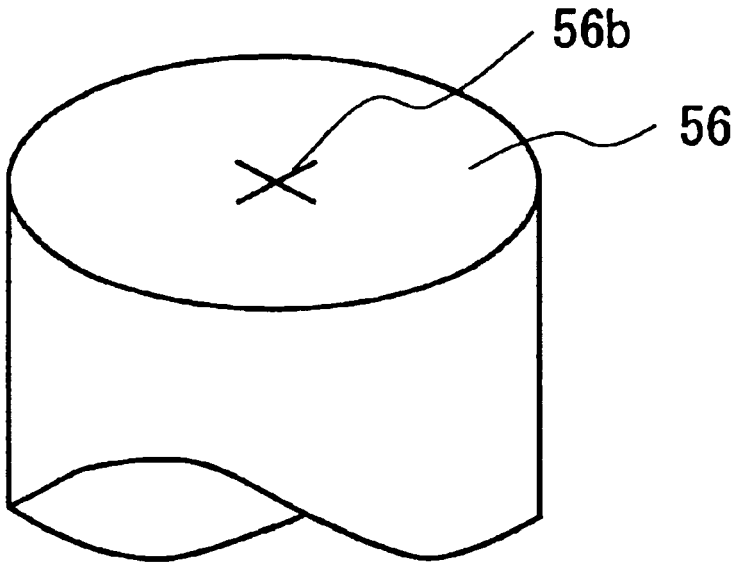
FIG. 14 shows another embodiment of the packing retainer for the packing member.

As for the ink cartridge 2 according to the present invention, the ink of the ink supply port 6 is sealed by the connection between the packing member 8 and the valve member 10. Thus, it is not necessary to close the external opening 14 with a sealing film or any equivalent member thereof. Therefore, as shown in FIGS. 13(A) and 13(B), the sealing film 56 provided at the external opening 14 may be formed with a hole 56*a* which enables the ink supply needle 104 to pass through. The hole may be formed by cutting the film in a cross shape as shown in FIG. 14. By making the hole, the ink supply needle smoothly passes through the film.

Figure 15:
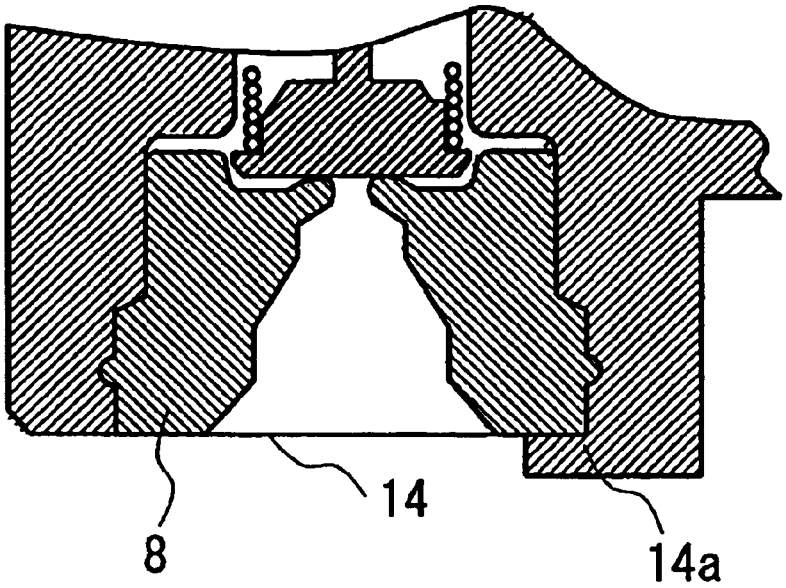
FIG. 15(A) is a cross sectional view of another embodiment of the packing retainer for the packing member.
FIG. 15(B) shows the packing retainer for the packing member shown in FIG. 15(A)
Figure 15:
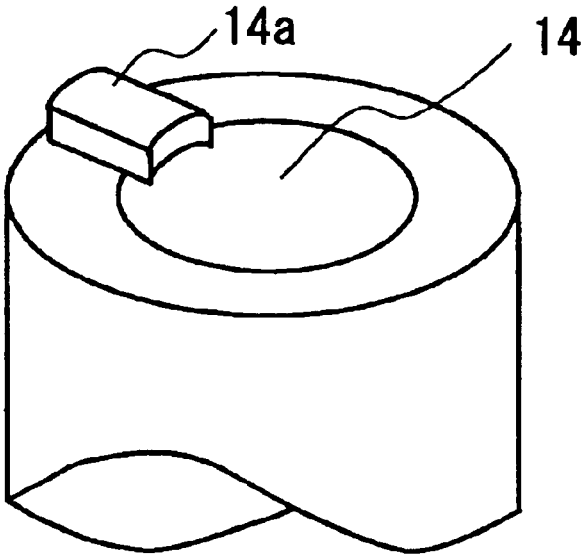

Furthermore, as shown in FIGS. 15(A) and 15(B), the ink cartridge 2 may have a protruding portion 14*a* protruding from the external opening 14 toward the center thereof, as a retainer for retaining the packing member 8 at the external opening 14 of the ink supply port 6. The protruding portion can be simply formed by protruding a part of the external opening 14. The result is, the number of parts or components and manufacturing process are reduced.

Figure 16:
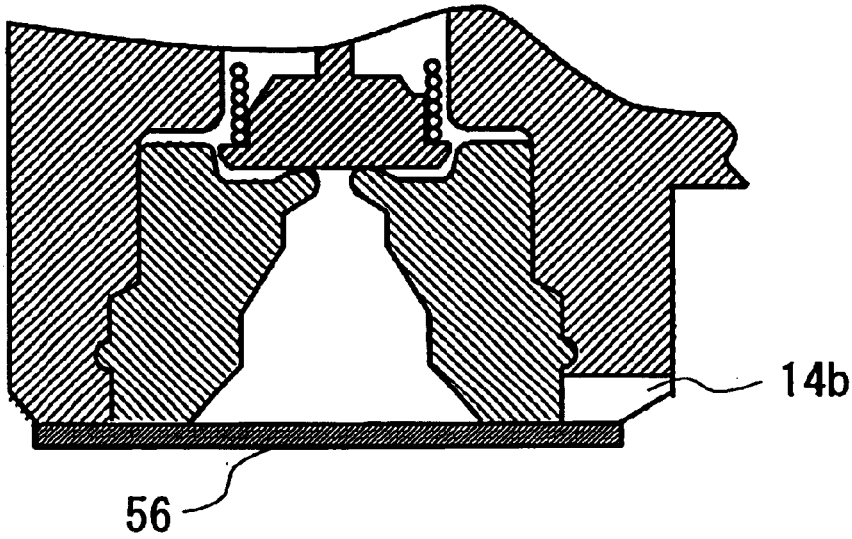
FIG. 16(A) is a cross sectional view of another embodiment of the packing retainer for the packing member.
FIG. 16(B) shows the packing retainer for the packing member shown in FIG. 16(A)
Figure 16:
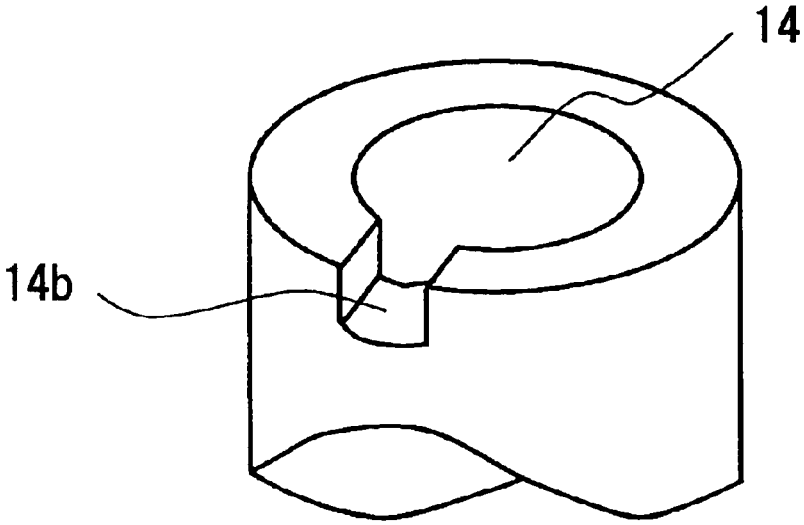

The external opening 14 may have a retreating opening 14*b* as shown in FIG. 16(A) and 16(B). The sealing film 56 is attached at the external opening 14 to retain the packing member 8 at the external opening 14.

In this embodiment, the ink supply port 6 is open to the external ambient air, therefore, the packing member 8 and the valve member 10 are not influenced by the expansion and the contraction of the air in the ink supply port 6.

Figure 17:
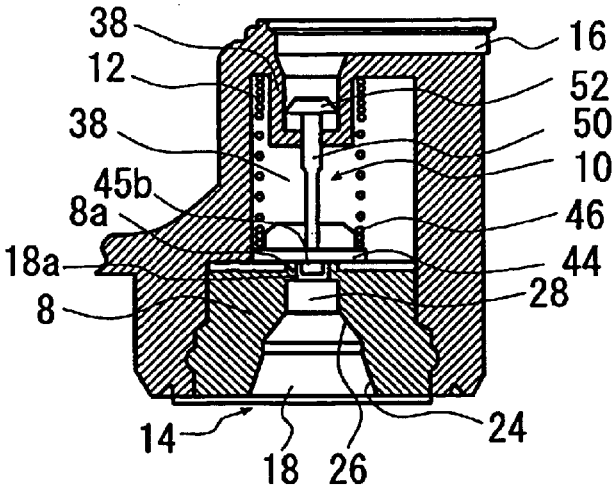
FIG. 17(A) is a cross sectional view of another embodiment of the ink cartridge according to the present invention.
FIG. 17(B) shows the ink cartridge shown in FIG. 17(A) with the ink supply needle of the printing apparatus.
FIG. 17(C) shows the ink cartridge shown in FIG. 17(A) with the ink supply needle of the printing apparatus inserted therein.
Figure 17:
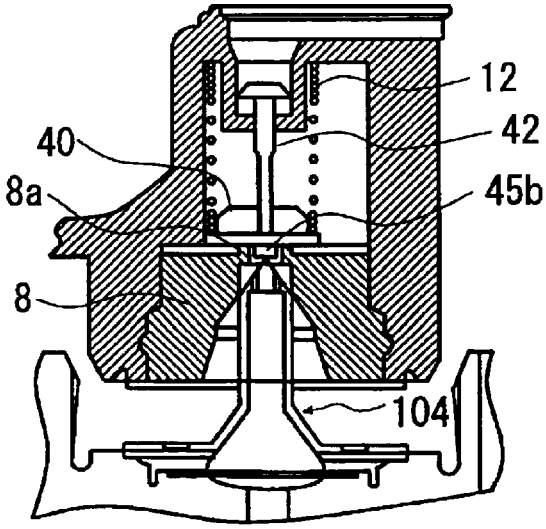
Figure 17:
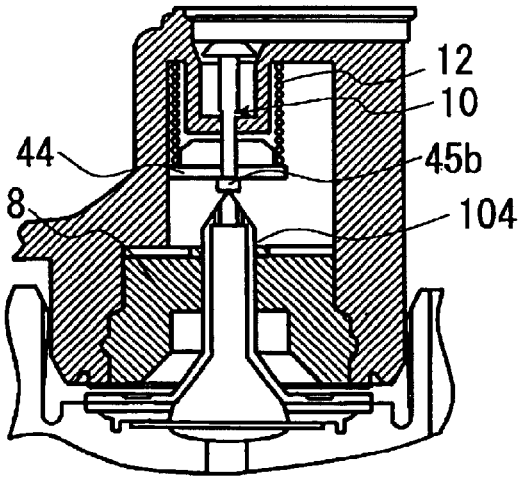

FIG. 17(A) 17(B) and 17(C) show another embodiment of the ink cartridge according to the present invention. - A packing member 8 and a valve member 10 are provided in the ink supply port 6 in the same way as the embodiment shown in FIG. 2. The ink supply port 6 has an external opening 14 designed to face the ink supply needle 104 of the printing apparatus, and an internal opening 16 designed to open to the ink chamber 4. The parts and components having the same symbols as FIG. 2 and not specifically mentioned here have the same operations and effects as those shown in FIG. 2.

The packing member 8 has a first surface facing the ink chamber 4 with a protruding portion 8*a* protruding from the fitting portion 28 toward the ink chamber 4. The first surface has a hole 18*a*, whose diameter is smaller than the diameter of the needle of the recording apparatus.

The packing member 8 has a second surface facing the external opening 14 with a first tapered portion 24 and a second tapered portion 26 each tapered from the external opening 14 toward the ink chamber 4 at the second surface. The function of this is to guide the ink supply needle 104 of the printing apparatus. The packing member 8 further has a fitting portion 28 to fit with the ink supply needle 104 of the printing apparatus.

The valve member 10 has a valve body 40 and a guide body 42. The valve body 40 has a sealing portion 44 and a spring support structure 46. The guide body 42 has an external portion 50 and a guide block 52. The sealing portion 44 of the valve body 40 has a surface facing the packing member 8 formed with a protruding portion 45*b* to contact with the tip end of the ink supply needle 104. The protruding portion 45*b* has a size compatible with the hole 18*a* of the protruding portion 8*a* of the packing member 8. The valve member 10 is received in the guide unit 38 of the ink introducing chamber 36, to be moved vertically with respect to the packing member 8.

The protruding portion 45*b* has a height that permits it to form a contact with the tip end of the ink supply needle 104 at the time when the ink supply needle 104 forms a sealed connection with the packing member 8 as shown in FIG. 17(B). It means that the valve member 10 is urged by the ink supply needle 104 to open the ink supply port 6 at the time when the ink supply needle 104 and the packing member 8 form a sealed connection with each other. Thus, undesirable air or bubble do not enter the ink supply port 6.

In this embodiment, the tip end of the ink supply needle 104 contacts the protruding portion 45*b* of the sealing portion 44 at the time when the tapered ink supply needle 104 fits with the packing member 8. This forms a sealed connection between them, by mounting the ink cartridge 2 on the printing apparatus.

When the ink cartridge 2 is further pushed toward the printing apparatus, the ink supply needle 104 fits into the fitting portion 34 of the packing member and is inserted into the hole 18*a* of the protruding portion 8*a* of the packing member 8 whilst forcing out any air. Then, the ink can be provided to the print head 102. The valve member 10 is forcibly separated from the packing member 8 when the ink supply needle 104 is inserted into the ink supply port 6 whilst forming a sealed connection with the packing member 8 as described above. Therefore, the air compressed by the ink supply needle when it is inserting in the ink supply port does not enter the ink supply port 6 and the ink supply needle 104.

When, on the other hand, the cartridge 2 is removed from the printing apparatus, the ink supply needle 104 is detached from the packing member 8. The valve member 10 is urged toward the packing member 8 by the elastic force of the compression spring 12. The protruding portion 45*b* of the sealing portion 44 of the valve member 10 is accepted into the hole 18*a* of the packing member 8, whilst the ink supply needle 104 be detached from the packing member 8. The sealing portion 44 of the valve member 10 forms a contact with the protruding portion 8*a* of the packing member 8. This closes the ink introducing chamber 36 when the ink supply needle 104 is almost detached from the packing member 8 but is still forming the sealed connection with the fitting portion 28 of the packing member 8. Thus, the ink does not leak from, and undesirable air or bubble does not enter the ink cartridge through the external opening 14 of the ink supply port.

Figure 18:
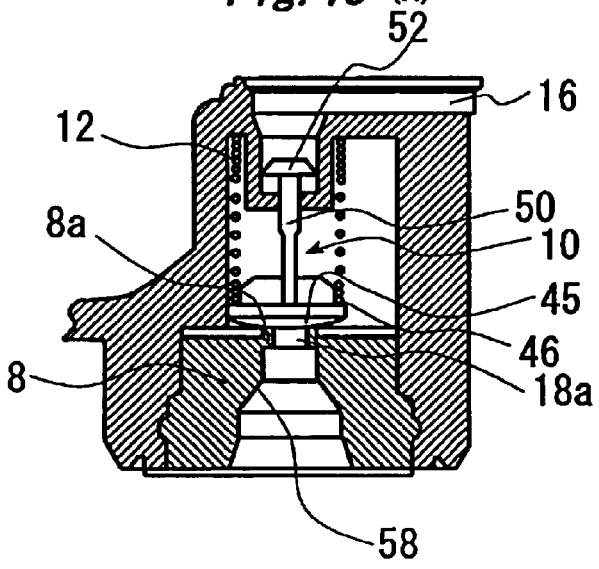
FIG. 18(A) is a cross sectional view of another embodiment of the ink cartridge according to the present invention.
FIG. 18(B) shows the ink cartridge shown in FIG. 18(A) with the ink supply needle of the printing apparatus.
FIG. 18(C) shows the ink cartridge shown in FIG. 18(A) with the ink supply needle of the printing apparatus inserted therein.
Figure 18:
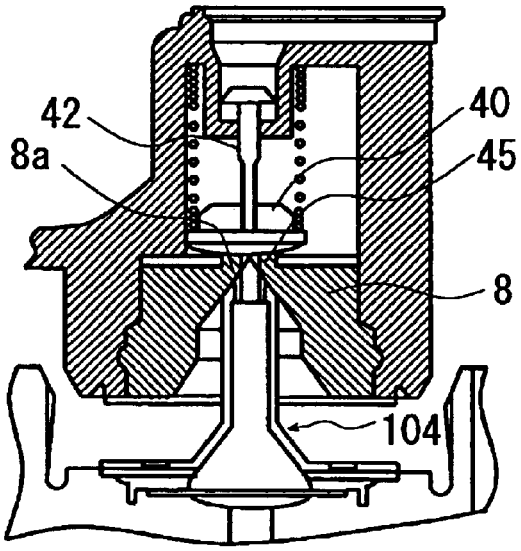
Figure 18:
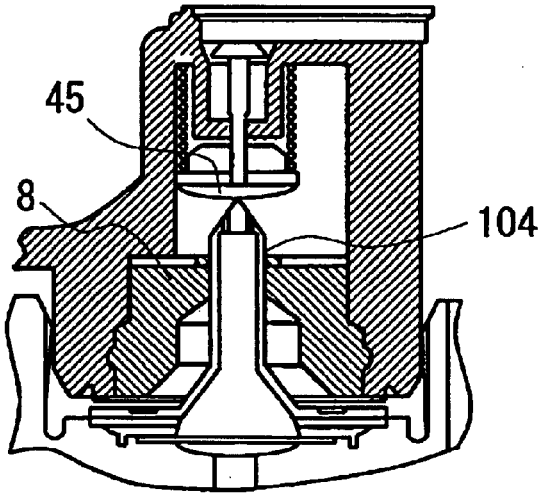

FIG. 18(A) 18(B) and 18(C) show another embodiment of the ink cartridge according to the present invention. The ink cartridge has a packing member 8. The packing member 8 has a protruding portion 8*a* and a hole 18*a* formed at the protruding portion 8*a* of the packing member 8 in the same way as that shown in FIGS. 17(A) 17(B) and 17(C).

The valve member 10 has a valve body 40 and a guide body 42. The valve body 40 has a sealing portion 44 and a spring support structure 46. The guide body 42 has an axial portion 50 and a guide block 52. The sealing portion 44 of the valve body 40 has a surface facing the packing member 8, formed with a convex surface 45. The convex surface 45 is a spherical surface. The spherical surface of the valve body 40 has a diameter of curvature larger than a diameter of a widest part of the valve body 40.

Figure 19:
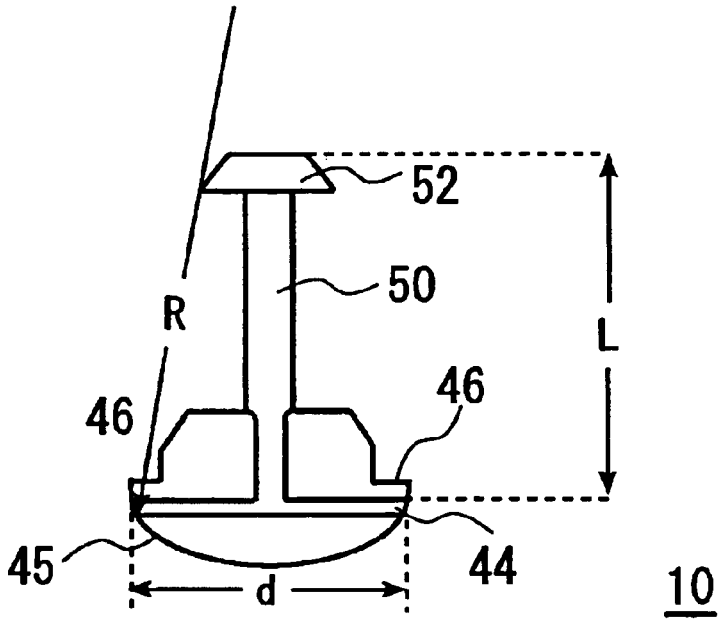
FIG. 19(A) is a cross sectional view of the valve member shown in FIG. 18(A) to 18(C)
FIG. 19(B) is a cross sectional view of another embodiment of the valve member.
FIG. 19(C) is a cross sectional view of another embodiment of the valve member.
Figure 19:
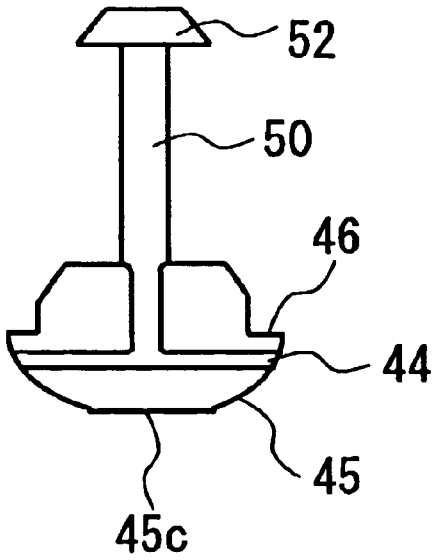
Figure 19:
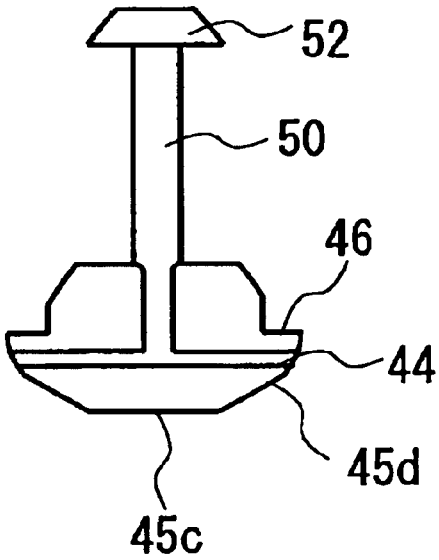

FIG. 19(A) shows an enlarged cross sectional view of the valve member 10 having a spherical convex surface 45. The convex surface 45 of the sealing portion 44 of the valve body 40 is like a part of a sphere having a diameter "R". The diameter R of the sphere is larger than the length "L" of the axial portion 50 of the valve member 10. Thus, the sealed connection between the packing member 8 and the valve member 10 is ensured even when the position of the valve member 10 varies.

Assuming the diameter of curvature of the spherical convex surface 45 of the valve body 40 as "R", "2R" (2×R) is at least longer than the widest part "d" of the valve body 40 as shown in FIG. 19(A).

In this embodiment, the tip end of the ink supply needle 104 contacts the spherical convex 45 of the sealing portion 44. This occurs at the time when the tapered ink supply needle 104 fits with the packing member 8, to form the sealed connection with each other when mounting the ink cartridge 2 on the printing apparatus.

When the ink cartridge 2 is further pushed toward the printing apparatus, the ink supply needle 104 is guided by the tapered portion 58 to contact with the center of the convex surface 45 of the valve member 10. Under this condition, the ink supply needle 104 is inserted into the hole 18*a* of the protruding portion 8*a* of the packing member 8.

The valve member 10 is forced to come out of contact with the packing member 8 when the ink supply needle 104 is inserted into the ink supply port 6 whilst forming the sealed connection with the packing member 8 as described above. Therefore, the air compressed by the ink supply needle does not enter the ink supply port 6.

Further in this embodiment, the ink supply needle 104 contacts with the center of the spherical convex surface 45 having a large diameter of curvature, and the valve member 10 is regulated by its axial portion 50, therefore, contact between the valve member 10 and the ink supply needle 104 is ensured.

When, on the other hand, the cartridge 2 is removed from the printing apparatus, the ink supply needle 104 is detached from the packing member 8. The valve member 10 is urged toward the packing member 8 by the elastic force of the compression spring 12. The convex surface 45 of the sealing portion 44 of the valve member 10 forms a contact with the protruding portion 8*a* of the packing member 8, to close the ink introducing chamber 36. This occurs when the ink supply needle 104 is almost detached from the packing member 8 but is still forming a sealed connection with the fitting portion 28 of the packing member 8. Thus, the ink does not leak from, and undesirable air bubbles do not enter the external opening 14. Furthermore, as the sealing portion 44 has the spherical convex surface 45, the sealed connection between the packing member 8 and the valve member 10 is ensured even when the position of the valve member 10 varies.

The spherical convex surface 45 of the valve member 10 may have a flat surface 45*c* having a diameter smaller than the diameter of the hole 18*a* of the protruding portion 8*a* of the packing member 8 as shown in FIG. 19(B). In this case, the contacting surface between the ink supply needle 104 and the valve member 10 is large, to enforce the contact therebetween without reducing the sealed connection between the ink supply needle 104 and the packing member 8.

Furthermore, the closing surface 44 of the valve member 10 may be formed as a conical shape 45*d* having its point removed, to leave a flat surface 45*c* remained. In this case, the contact between the ink supply needle 104 and the valve member 10 is enforced as well, without reducing the sealed connection between the ink supply needle 104 and the packing member 8.

Figure 20:
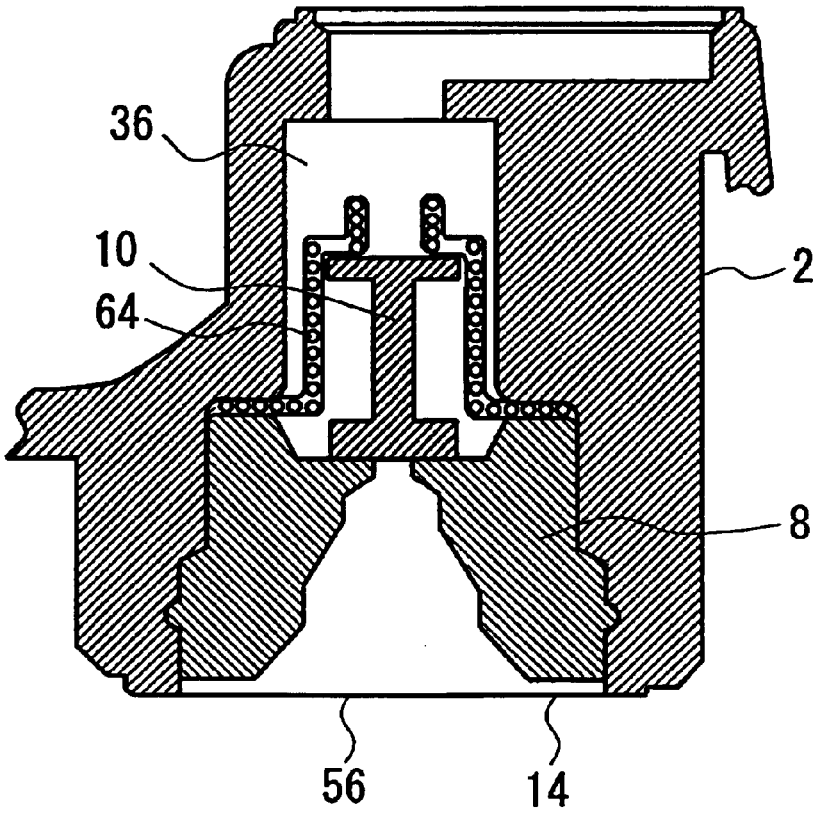
FIG. 20 shows the ink cartridge comprising an extension spring.

The elastic member may be an extension spring 64 as shown in FIG. 20. The extension spring 64 is fixed to the ink cartridge 2 at an end by the packing member 8 to have the other end of the extension spring 64 contact with the valve member 10. The valve member 10 is forced toward the packing member 8. In this case, the valve member does not need to have a spring support structure 46, and the ink cartridge 2 does not need to have a guide unit 38 in the ink introducing chamber 36. The result is, that the structure of the ink cartridge 2 can be simplified, thus, the manufacturing process can be reduced.

Figure 21:
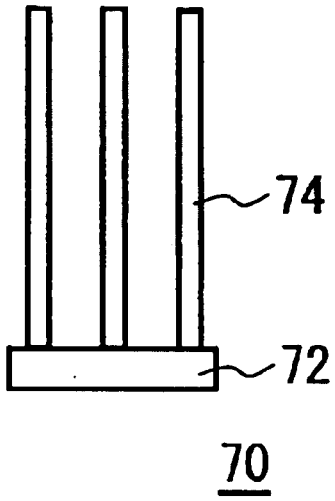
FIG. 21(A) is a cross sectional view of another embodiment of the valve device comprising three elastic support portions.
FIG. 21(B) is a cross sectional view of the valve device shown in FIG. 21(A) with the ink supply needle of the printing apparatus.
FIG. 21(C) shows the valve device shown in FIG. 21(A)
FIG. 21(D) shows the valve device shown in FIG. 21(A) with the ink supply needle of the printing apparatus.
Figure 21:
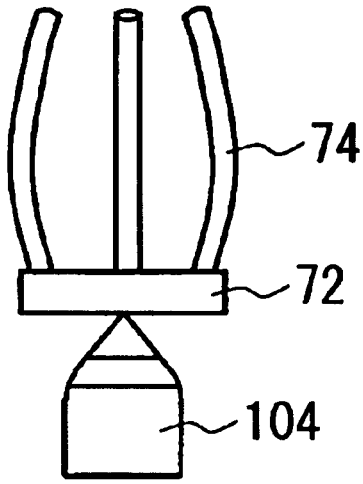
Figure 21:
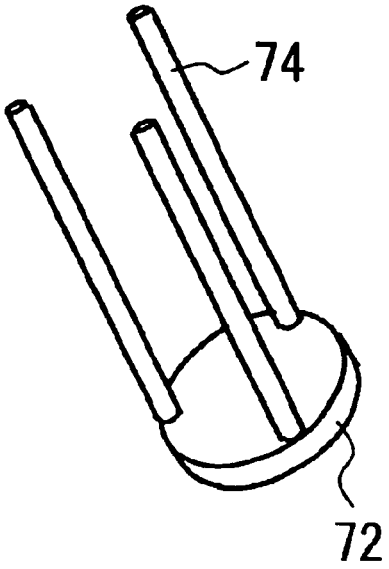
Figure 21:
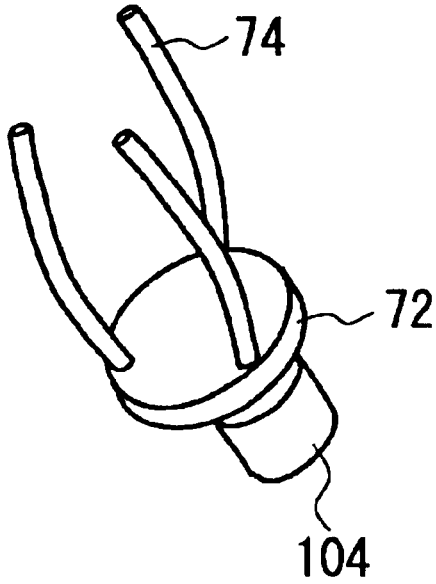
Figure 22:
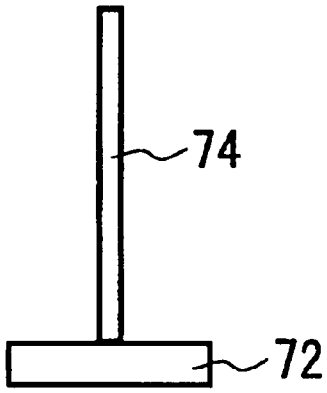
FIG. 22(A) is a cross sectional view of another embodiment of the valve device comprising a elastic support portion.
FIG. 22(B) is a cross sectional view of the valve device shown in FIG. 22(A) with the ink supply needle of the printing apparatus.
FIG. 22(C) shows the valve device shown in FIG. 22(A)
FIG. 22(D) shows the valve device shown in FIG. 22(A) with the ink supply needle of the printing apparatus.
Figure 22:
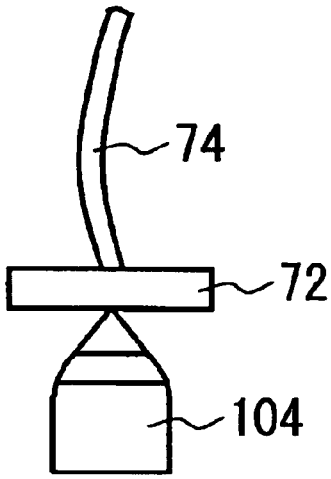
Figure 22:
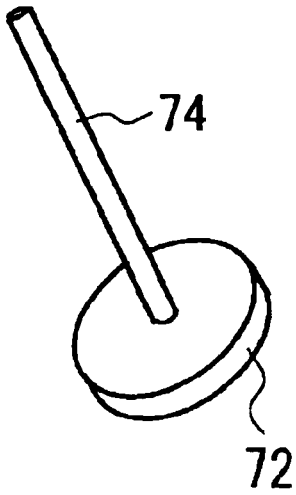
Figure 22:
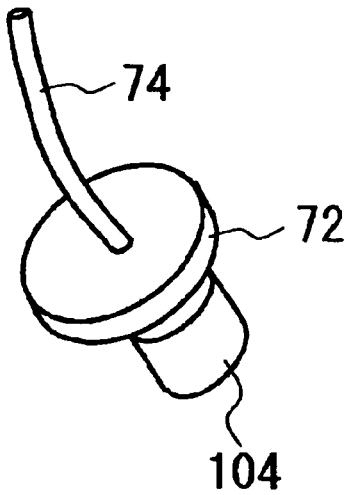

FIGS. 21 and 22 shows another example of the valve device according to the present invention. The valve device 70 has a valve body 72 to form contact with the packing member 8, and an elastic support portion 74 for supporting the valve body 72 in order to have the valve body 72 contact with the packing member 8. The elastic support portion 74 is made of an elastic material such as a hard rubber, a plastic material having a high elastic modulus, or an elastomer material. The elastic support portion 74 is capable of bending when the ink supply needle 104 fits with the packing member, to urge the valve body 72 of the valve device 70. The valve body 72 and the elastic support portion 74 may be separately formed, or may be formed as one unit. The elastic support portion 74 of the valve device 70 urges the valve body 72 toward the packing member 8. At the same time, the valve body 72 contacts with the packing member 8, and guides the valve member vertically with respect to the packing member 8. Therefore, the number of parts can be reduced.

The valve device 70 may have a plurality of elastic support portions 74, for example, three in FIG. 21, or only one elastic support portion 74 as shown in FIG. 22.

Figure 23:
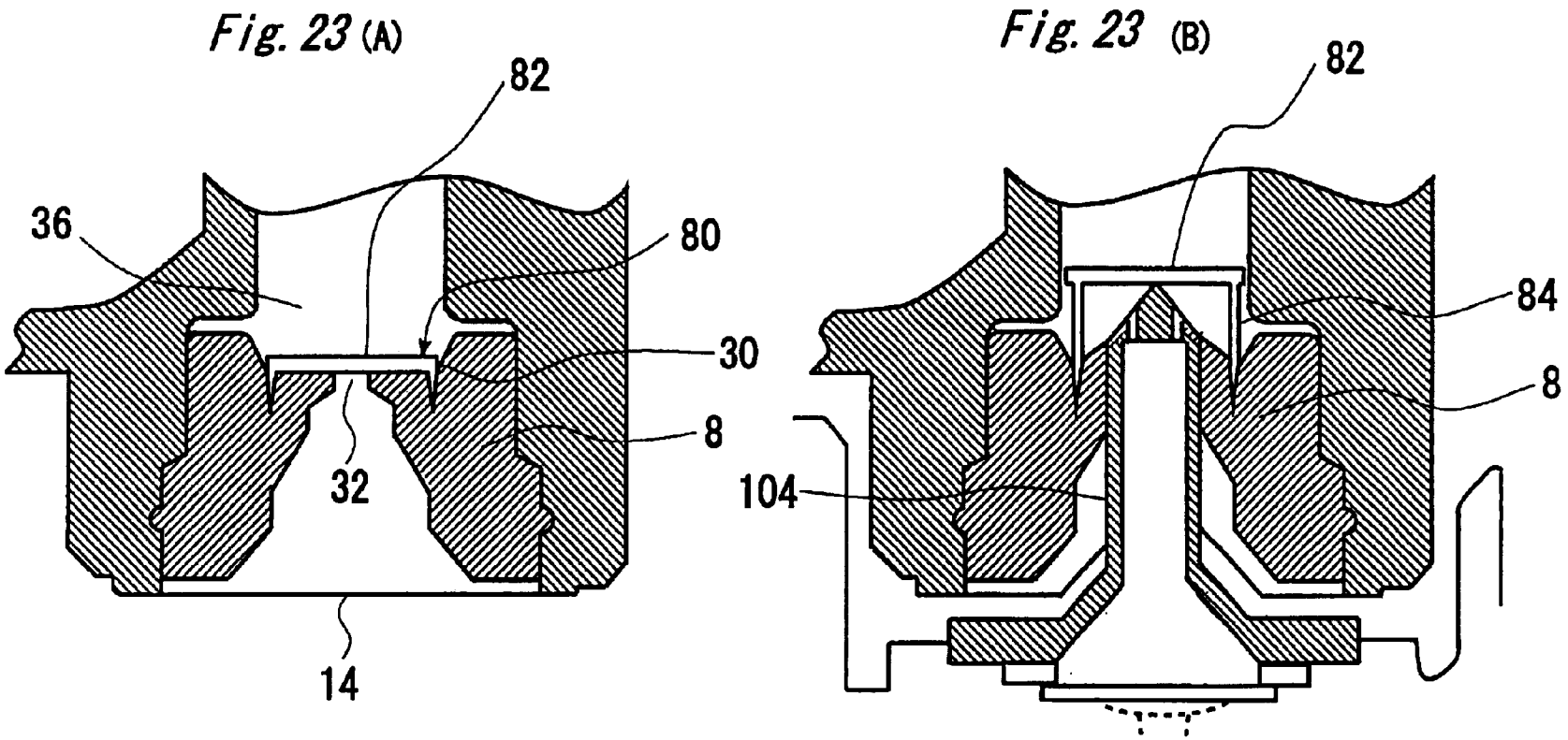
FIG. 23(A) shows another embodiment of the valve device.
FIG. 23(B) shows the valve device shown in FIG. 23(A) with the ink supply needle of the printing apparatus.

FIG. 23(A) and 23(B) show another embodiment of the valve device according to the present invention. The valve device 80 has a valve member 82 to form a contact with the packing member 8 and an elastic member 84 for urging the valve member 82 toward the packing member 8 in order to have the valve member 82 contact with the packing member 8. The elastic member 84 is made of a polymeric elastomer or a rubber capable of expanding.

The valve body 82 is urged to selectively contact with the packing member 8 by the elastic member 84 connected to the cylindrical recess 30 of the packing member 8 in the embodiment shown in FIG. 23(A). The valve body 82 is urged by the ink supply needle 104 of the printing apparatus toward the ink chamber, to open the valve device 80. Thus, the ink is provided from the ink chamber to the print head 102 of the printing apparatus through the hole of the ink supply needle 104.

Figure 24:
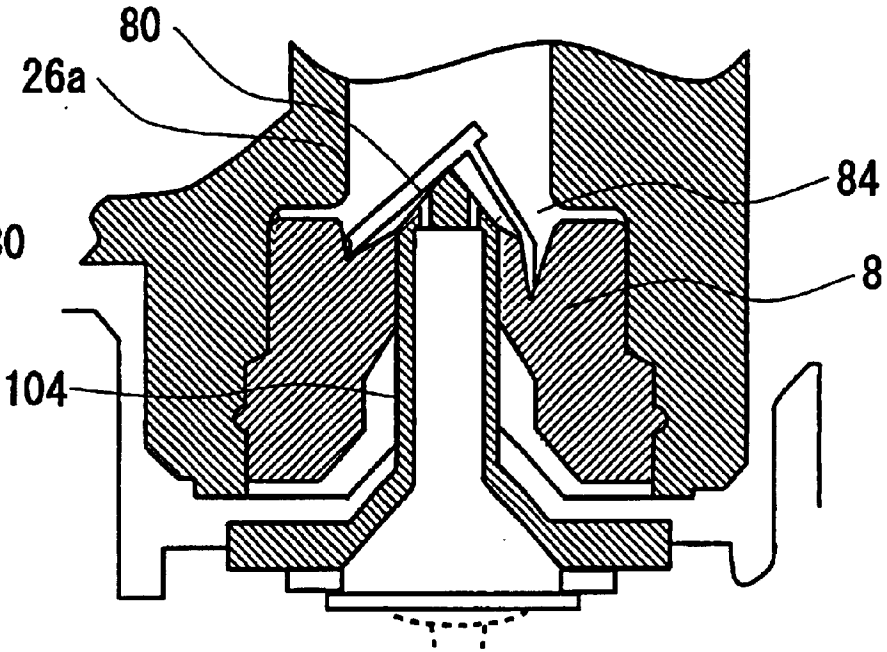
FIG. 24(A) shows another embodiment of the valve device.
FIG. 24(B) shows the valve device shown in FIG. 24(A) with the ink supply needle of the printing apparatus.
Figure 24:
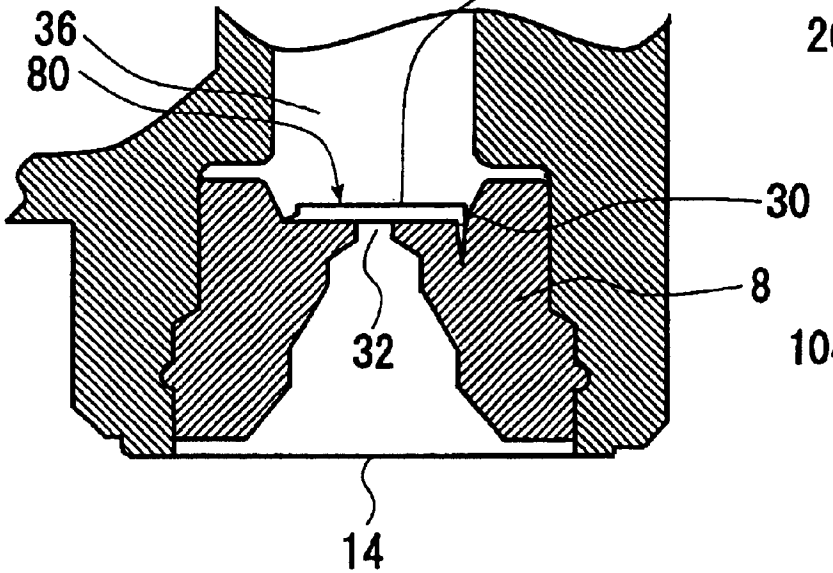

A part of the valve body 82 is fixed at the packing member 8 as shown in FIGS. 24(A) and 24(B). The valve body 82 is urged to contact with the packing member 8 by the elastic member 84 in this case as well. The valve body 84 is urged toward the ink chamber by the ink supply needle 104, to open the hole of the packing member 8. The ink is then provided from the ink chamber to the print head 102 of the printing apparatus through the hole of the ink supply needle 104.

The valve device 80 may be formed as one unit with the packing member 8. It means that the valve device 80 is fixed to the packing member 8 as its part. Thus, the number of parts and manufacturing process can be reduced.

Figure 25:
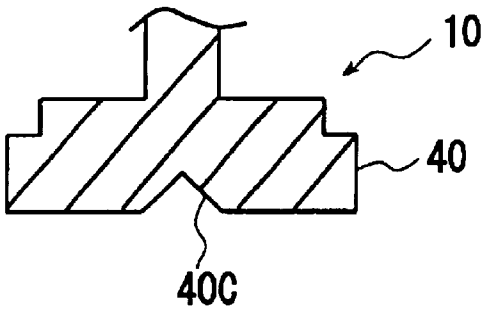
FIG. 25(A) is a cross sectional view of another embodiment of the valve member.
FIG. 25(B) shows the valve member shown in FIG. 25(A) with the ink supply needle of the printing apparatus.
FIG. 25(C) is a cross sectional view of another embodiment of the valve member.
FIG. 25(D) shows the valve member shown in FIG. 25(C) with the ink supply needle of the printing apparatus.
Figure 25:
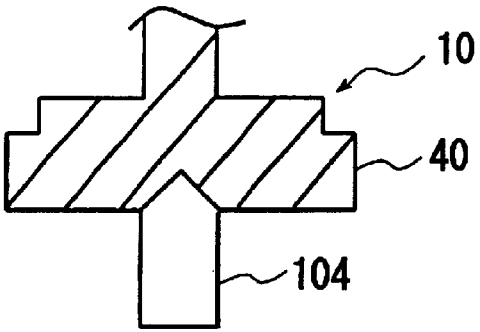
Figure 25:
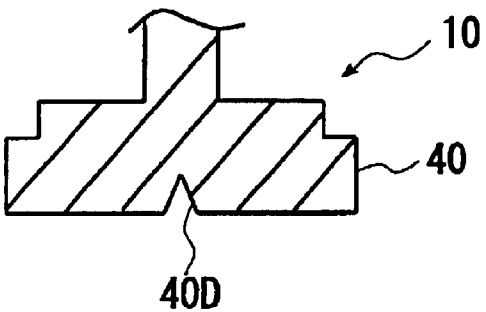
Figure 25:
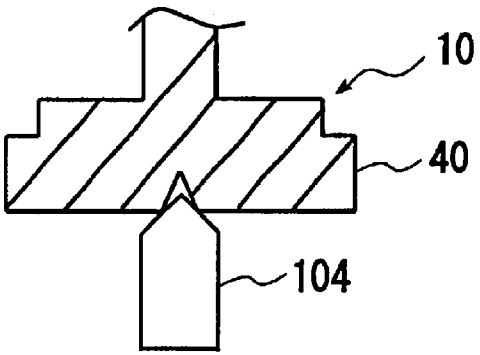

The valve body 40 of the valve member 10 may have a surface facing the packing member provided with a notch as shown in FIGS. 25(A) to 25(D). The notch 40*c* of the valve body 40 shown in FIGS. 25(A) and 25(B) has an angle the same as that of the tapered ink supply needle 104. The notch 40*d* of the valve body 40 shown in FIGS. 25(C) and 25(D) has an angle smaller than that of the tapered ink supply needle 104. These reduce the damage to the ink supply needle 104 when the ink supply needle 104 urges the valve member 10. In particular, when the ink supply needle 104 contacts the valve body 40 as shown in FIGS. 25(C) and 25(D), the tip end of the ink supply needle 104 does not contact with the valve body 40 of the valve member 10, therefore the tip end of the ink supply needle 104 is not damaged.

Figure 26:
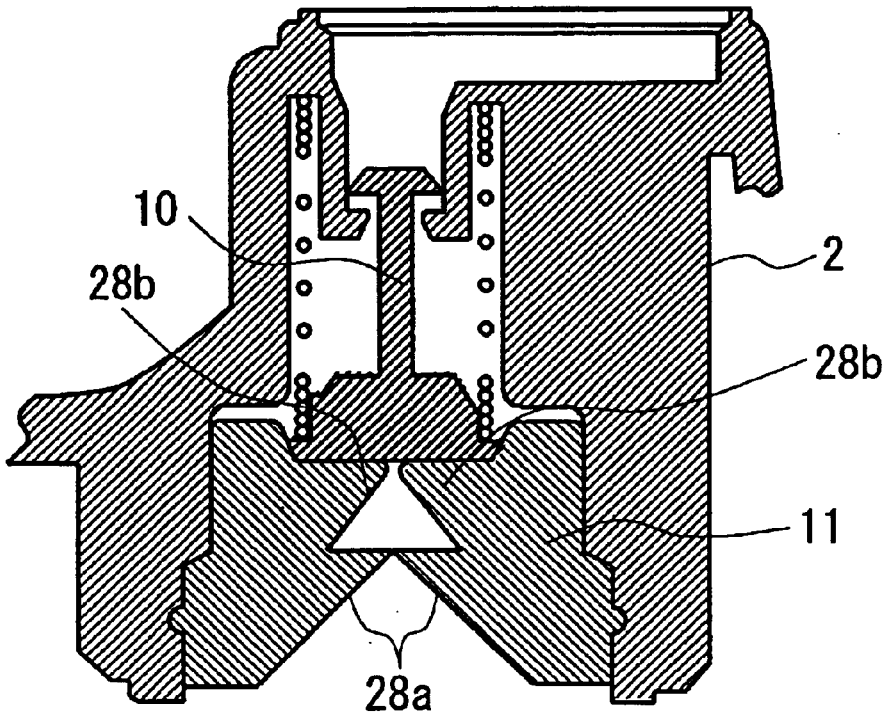
FIG. 26 shows another embodiment of the ink cartridge according to the present invention.
Figure 27:
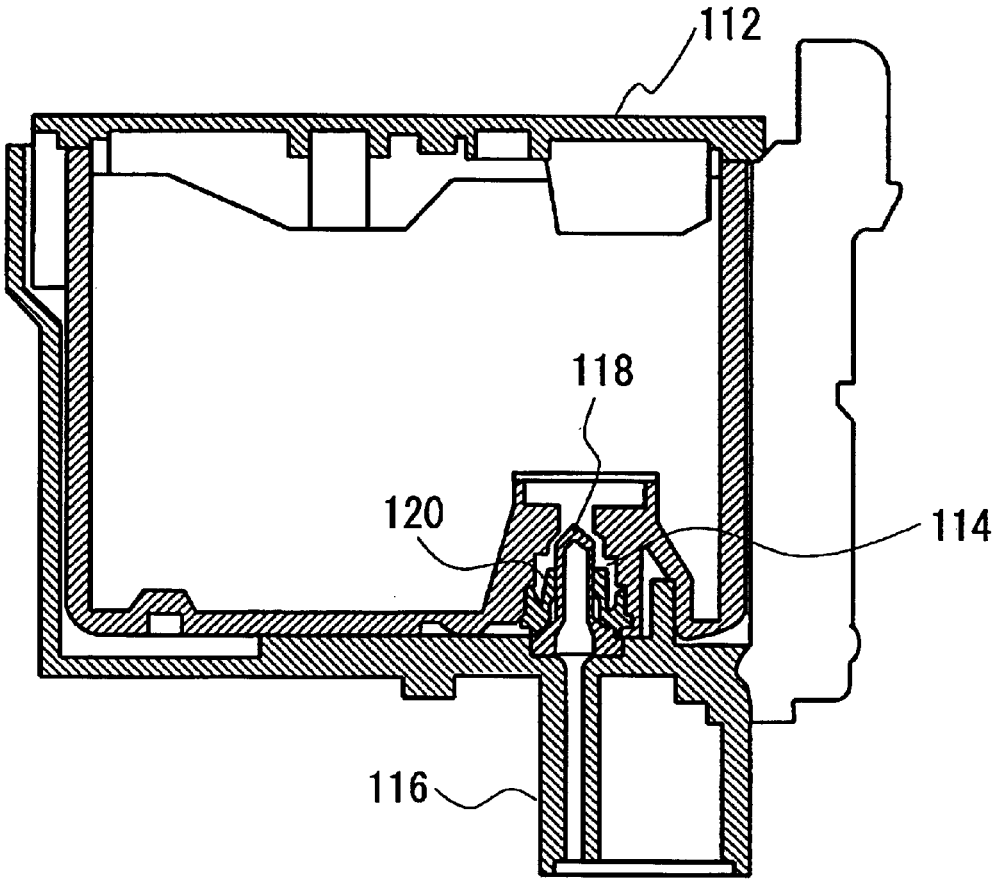
RELATED ART Fig. 27
FIG. 27 shows a cross sectional view of the conventional ink cartridge with a part of the printing apparatus comprising the print head.
Figure 28:
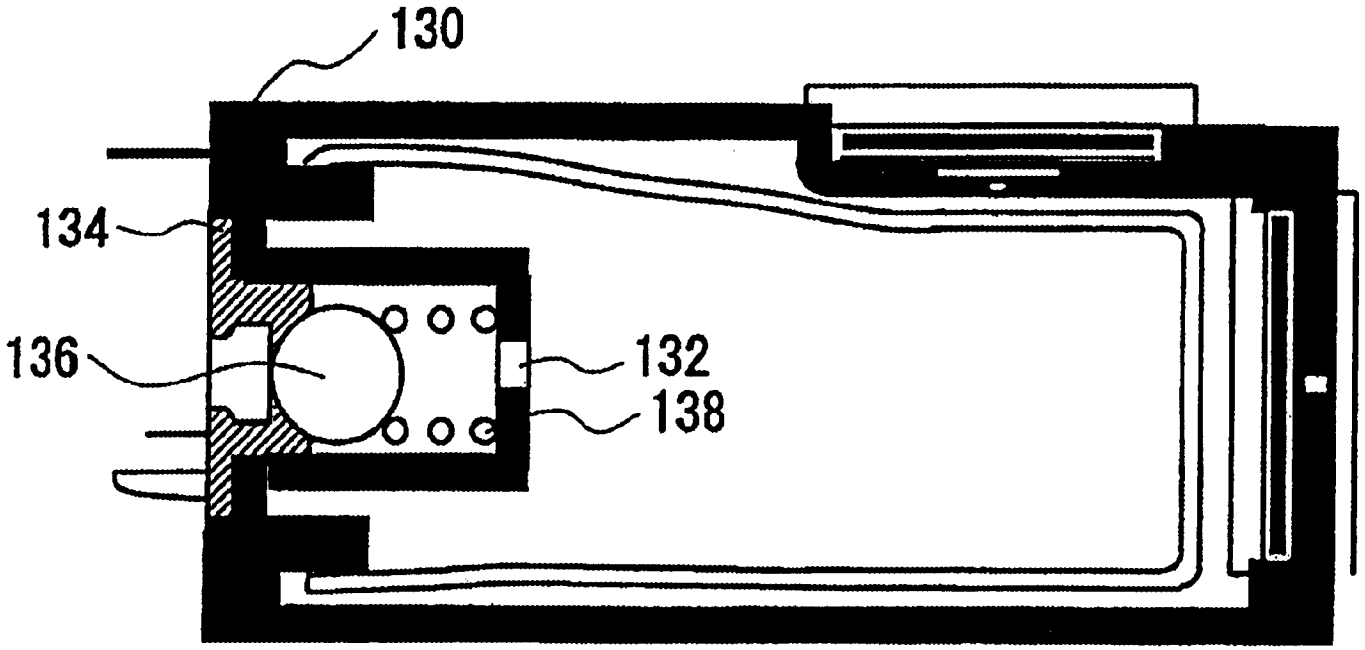
PRIOR ART Fig. 28
FIG. 28 is a cross sectional view of another embodiment of the conventional ink cartridge.

The packing member 8 may have two fitting portions, a first fitting position 28*a* for fitting the ink supply needle of the printing apparatus when the ink supply needle 104 is inserted from the external opening 14, and a second fitting position 28*b* for fitting the ink supply needle 104 when the ink supply needle 104 is further inserted toward the ink chamber 4. In this case, each of the fitting portions 28*a* and 28*b* fits with the ink supply needle 104. Thus, the sealed connection between the packing member and the ink supply needle 104 can be enforced. Each of the fitting portions 28*a* and 28*b* may be formed with or without a hole. Preferably, the fitting portion 28*a* closer to the external opening 14 is not formed with a hole and is sealed initially prior to use. In such a case, the number of parts can be reduced because the ink cartridge does not have a sealing film to seal the supply port 6 prior to use. Even in this case, the fitting portion 28*a* is formed as tapered as shown in FIG. 26, so the ink supply needle 104 can smoothly penetrate the sealed fitting portion 28*a*.

The ink cartridge according to the present invention may be used as an off-carriage type ink cartridge which is mounted on a fixed part of the body of the printer and connected to the print head which is mounted on the carriage, through a flexible ink supply tube.

The ink cartridge according to the present invention may also be applied to a printing apparatus in which a heating element is used as a pressurizing means not only to the printing apparatus in which the piezoelectric transducer is used as a pressurizing means of the print head.

As described above, according to the present invention, an ink cartridge and an ink supply system are capable of closing the ink supply channel when it is not mounted on the printing apparatus and capable of opening the ink supply channel to provide ink to the print head when it is mounted on the printing apparatus. A printing apparatus employing the ink cartridge or the ink supply system is also provided by the present invention.

Furthermore, Ink can be supplied from the ink supply port to the ink supply needle without having air or bubble enter the ink supply port because the valve device is urged by the ink supply needle of the printing apparatus to open the ink channel under a state where the ink supply needle is sealed by the packing member.

Furthermore, the ink supply port can be sealed without having air or bubble enter the ink supply port because the valve device comes to close the ink channel of the packing member before the ink supply needle of the printing apparatus is completely detached from the packing member.

Furthermore, the ink supply needle can be smoothly inserted in the packing member because the packing member is made of an elastic material and provided with a lubricant coat at least at an area with which the ink supply needle contacts.

Furthermore, the packing member can seal the ink supply needle because the packing member includes a tapered portion or a fitting portion fitting the ink supply needle.

Furthermore, the ink supply needle can securely contact with the valve device, because the valve device includes a substantially flat surface with which the ink supply needle contacts.

Furthermore, the valve body can be moved substantially vertically with respect to the packing member because the valve device includes a guide body for guiding the valve body to slide substantially vertically with respect to the packing member.

Furthermore, manufacturing process can be simplified and reduced because the number of parts or components necessary for assembling the ink cartridge according to the present invention is reduced.

What is claimed is:

1. An ink cartridge for a printing apparatus providing ink to a print head through a tapered ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith;

a valve device contained in said ink supply port elastically abutting against said packing member, said valve device selectively opening and closing said ink channel in conjunction with the ink supply needle, wherein said valve device does not comprise a sphere; and a sealing film sealing said external opening of said ink supply port until said ink supply needle penetrates into said ink supply port.

2. An ink cartridge as set forth in claim 1, wherein said packing member comprises a second surface facing said external opening with the tapered portion tapered from said external opening toward said ink chamber at said second surface, for guiding the ink supply needle of the printing apparatus.

3. An ink cartridge as set forth in claim 2, wherein said taper portion fits with the ink supply needle.

4. An ink cartridge as set forth in claim 1, wherein said packing member comprises a second surface facing said external opening with a fitting portion to fit with the ink supply needle of the printing apparatus.

5. An ink cartridge as set forth in claim 4, wherein said fitting portion comprises a first fitting position for fitting the ink supply needle of the printing apparatus when the ink supply needle is inserted from said external opening, and a second fitting position for fitting the ink supply needle on the ink supply needle is further inserted toward said ink chamber.

6. An ink cartridge as set forth in claim 5, wherein said first fitting position is initially sealed prior to use.

7. An ink cartridge as set forth in claim 1, wherein said packing member is made of an elastic material and provided with a lubricant coat at least at an area with which the ink supply needle contacts.

8. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith, said packing member comprising a hole and a protruding rim surrounding said hole; and a valve device contained in said ink supply port, closing said ink channel by elastically abutting against said protruding rim of said packing member, said valve device selectively opening and closing said ink channel in conjunction with the ink supply needle;

wherein said abutting of said valve device against only an upper part of said protruding rim performs said closing of said ink channel.

9. An ink cartridge as set forth in any one of claims 1 or 8, wherein said valve device comprises:

a valve member selectively contacting with a surface of said packing member, said valve member being forced by the ink supply needle of the printing apparatus when the ink cartridge is mounted on the printing apparatus; and an elastic member always urging said valve member toward said packing member.

10. An ink cartridge as set forth in claim 9, wherein said valve member comprises a support structure for supporting said elastic member.

11. An ink cartridge as set forth in claim 10, wherein said support structure is radially shaped.

12. An ink cartridge as set forth in claim 9, wherein said valve member comprises a flange for supporting said elastic member.

13. An ink cartridge as set forth in claim 10, wherein said valve body of said valve device comprises a surface formed with a spherical surface contacting with said packing member, and wherein said spherical surface of said valve device is formed with a flat portion with which the ink supply needle contacts.

14. An ink cartridge as set forth in any one of claims 1 or 8, wherein said valve device comprises:

a valve body contacting with said packing member and urged by the ink supply needle of the printing apparatus to open said ink channel when the ink cartridge is mounted on the printing apparatus; and an elastic support portion for supporting said valve body.

15. An ink cartridge as set forth in any one of claims 1 or 8, further comprising a packing retainer for retaining said packing member at said external opening of said ink supply port.

16. An ink cartridge as set forth in claim 15, wherein said packing retainer comprises a film capable of being penetrated by the ink supply needle of the printing apparatus.

17. An ink cartridge as set forth in claim 16, wherein said film is formed with a hole which enables the ink supply needle to easily pass through.

18. An ink cartridge as set forth in claim 17, wherein said hole is formed by cutting said film in a cross shape.

19. An ink cartridge as set forth in claim 15, wherein said packing retainer has a protruding portion protruding from said external opening toward the center thereof.

20. A printing apparatus as set forth in any one of claims 1 or 8, wherein said ink supply port includes a concave portion, and wherein said packing member includes a protruding portion extending toward said supply port and fitting with the concave portion of said ink supply port.

21. An ink cartridge as set forth in claim 8, wherein said packing member comprises a first surface facing said ink chamber formed with a cylindrical recess having a diameter acceptable to receive a part of said valve device at said first surface.

22. An ink cartridge as set forth in claim 21, wherein said hole of said packing member having a diameter smaller than said diameter of said cylindrical recess at said first surface.

23. An ink cartridge as set forth in claim 8, wherein:

said protruding rim is round in cross section and protrudes inward and toward said ink chamber, an inner periphery of said protruding rim defines said hole, and an upper periphery of said protruding rim abuts against said valve device to close the hole.

24. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising:

a valve body contacting with said packing member and urged by the ink supply needle of the printing apparatus to open said ink channel when the ink cartridge is mounted on the printing apparatus; and a guide body for guiding said valve body to slide substantially vertically with respect to said packing member, and operably suppressing a horizontal deviation of said valve device;

wherein said valve body comprises:

a sealing portion for closing said ink channel of said packing member when said valve device contacts with said packing member; and an ink channel allowing ink to pass therethrough when said valve body is urged to come out of contact with said packing member by the ink supply needle of the printing apparatus.

25. An ink cartridge as set forth in claim 24, wherein a part of said ink channel of said valve body is formed by cutting off said sealing portion.

26. An ink cartridge as set forth in claim 24, wherein said sealing portion of said valve body comprises a substantially flat surface with which the ink supply needle contacts.

27. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising:

a valve body contacting with said packing member and urged by the ink supply needle of the printing apparatus to open said ink channel when the ink cartridge is mounted on the printing apparatus; and a guide body for guiding said valve body to slide substantially vertically with respect to said packing member;

wherein said guide body comprises:

an axial portion being connected to said valve body; and a guide block formed at an end of said axial portion opposite to said valve body, said guide block guiding said valve body to slide substantially vertically with respect to said packing member.

28. An ink cartridge as set forth in claim 27, wherein said axial portion of said guide body is formed as one unit with said valve body.

29. An ink cartridge as set forth in claim 27, further comprising a guide unit provided in said ink supply port to receive said guide block of said guide body.

30. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising:

a valve body contacting with said packing member and urged by the ink supply needle of the printing apparatus to open said ink channel when the ink cartridge is mounted on the printing apparatus; and a guide body for guiding said valve body to slide substantially vertically with respect to said packing member, and operably suppressing a horizontal deviation of said valve device;

wherein said valve body and said guide body are separately formed and fixed to each other by fixing means.

31. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising:

a valve body contacting with said packing member and urged by the ink supply needle of the printing apparatus to open said ink channel when the ink cartridge is mounted on the printing apparatus; and a guide body for guiding said valve body to slide substantially vertically with respect to said packing member, and operably suppressing a horizontal deviation of said valve device;

wherein said valve body and said guide body are formed as one unit with each other.

32. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising:

a valve body contacting with said packing member and urged by the ink supply needle of the printing apparatus to open said ink channel when the ink cartridge is mounted on the printing apparatus, and a guide body for guiding said valve body to slide substantially vertically with respect to said packing member;

wherein said guide body comprises:

an axial portion being connected to said valve body, and a guide block formed at an end of said axial portion opposite to said valve body, said guide block guiding said valve body to slide substantially vertically with respect to said packing member; and wherein said guide body formed with a groove extending from said guide block through said axial portion.

33. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising:

a valve body contacting with said packing member and urged by the ink supply needle of the printing apparatus to open said ink channel when the ink cartridge is mounted on the printing apparatus, and a guide body for guiding said valve body to slide substantially vertically with respect to said packing member;

wherein said valve body of said valve device comprises a surface facing said packing member, and a member protruding from said Surface and contacting with a tip end of the ink supply needle.

34. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising:

a valve body contacting with said packing member and urged by the ink supply needle of the printing apparatus to open said ink channel when the ink cartridge is mounted on the printing apparatus, and a guide body for guiding said valve body to slide substantially vertically with respect to said packing member;

wherein said valve body of said valve device comprises a surface, facing said packing member, provided with a notch.

35. An ink cartridge as set forth in claim 34, wherein said notch of said valve body has a tapered angle which is the same as that of the tapered ink supply needle.

36. An ink cartridge as set forth in claim 34, wherein said notch of said valve body has a tapered angle which is smaller than that of the tapered ink supply needle.

37. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising a valve body contacting with said packing member and comprising a substantially flat surface with which the ink supply needle contacts;

wherein:

said valve body of said valve device comprises a surface formed with a spherical surface contacting with said packing member, and said spherical surface of said valve device has a diameter of curvature larger than a diameter of the widest part of said valve body.

38. A printing apparatus for ejecting ink on a printing medium, comprising:

a print head;

a tapered ink supply needle; and an ink cartridge capable of communicating with said print head through said tapered ink supply needle and removably attached to said print head, said ink cartridge comprising:

an ink chamber for containing ink;

an ink supply port for supplying ink from said ink chamber to the print head of the printing apparatus, said ink supply port comprising and external opening;

a packing member provided in said ink supply port, forming an ink channel for allowing a flow of ink, said packing member sealing the ink supply needle of the printing apparatus by fitting therewith; and a non-spherical valve device contained in said ink supply port, closing said ink channel by elastically abutting said protruding rim of said packing member, said valve device selectively opening and closing said ink channel in conjunction with the ink supply needle;

wherein said abutting of said valve device against only an upper part of said protruding rim performs said closing of said ink channel.

39. A printing apparatus as set forth in claim 38, wherein said valve device comprises:

a valve member selectively contacting with a surface of said packing member, said valve member being forced by said ink supply needle of the printing apparatus when said ink cartridge is mounted on the printing apparatus; and an elastic member always urging said valve member toward said packing member.

40. An ink cartridge for a printing apparatus providing ink to a print head through a tapered ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle;

wherein said ink supply port includes a concave portion, and wherein said packing member includes a protruding portion extending toward said supply port and fitting with the concave portion of said ink supply port.

41. An ink cartridge for a printing apparatus providing ink to a print head through an ink supply needle and removably attached to the print head, comprising:

an ink chamber for containing ink;

a porous member accommodated in said ink chamber for absorbing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle;

wherein:

said valve device does not comprise a sphere, and said ink supply port includes a concave portion, and wherein said packing member includes a protruding portion extending toward said supply port and fitting with the concave portion of said ink supply port.

42. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising a valve body contacting with said packing member and comprising a substantially flat surface with which the ink supply needle contacts;

wherein said ink supply port includes a concave portion, and wherein said packing member includes a protruding portion extending toward said supply port and fitting with the concave portion of said ink supply port.

43. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising:

a valve body contacting with said packing member and urged by the ink supply needle of the printing apparatus to open said ink channel when the ink cartridge is mounted on the printing apparatus, and a guide body for guiding said valve body to slide substantially vertically with respect to said packing member, and operably suppressing a horizontal deviation of said valve device;

wherein said ink supply port includes a concave portion, and wherein said packing member includes a protruding portion extending toward said supply port and fitting with the concave portion of said ink supply port.

44. An ink cartridge for a printing apparatus providing ink to a print head through an ink supply needle and removably attached to the print head, comprising:

an ink chamber for containing ink;

an ink supply port for supplying ink from said ink chamber to the print head of the printing apparatus, said ink supply port comprising an external opening;

a packing member provided in said ink supply port, forming an ink channel for allowing a flow of ink, said packing member sealing the ink supply needle of the printing apparatus by fitting therewith; and a valve device contained in said ink supply port elastically abutting against said packing member, said valve device selectively opening and closing said ink channel in conjunction with the ink supply needle, said valve device comprising:

a valve body contacting with said packing member and urged by the ink supply needle of the printing apparatus to open said ink channel when the ink cartridge is mounted on the printing apparatus; and a guide body for guiding said valve body to slide substantially vertically with respect to said packing member, and operably suppressing a horizontal deviation of said valve device;

wherein:

said valve body of said valve device comprises a surface formed with a spherical surface contacting with said packing member, and said spherical surface of said valve device has a diameter of curvature larger than a diameter of the widest part of said valve body.

* * * * *